US008616961B2

(12) United States Patent
Boyd et al.

(10) Patent No.: US 8,616,961 B2
(45) **Date of Patent: *Dec. 31, 2013**

(54) APPARATUS AND METHODS FOR IMPLEMENTING BONUSES IN GAMING MACHINE NETWORKS USING WEIGHTED PAY TABLES

(75) Inventors: Scott A. Boyd, Las Vegas, NV (US); Vincent S. Manfredi, Henderson, NV (US); Jay Roper, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/421,751

(22) Filed: Mar. 15, 2012

(65) Prior Publication Data

US 2012/0178524 A1 Jul. 12, 2012

Related U.S. Application Data

(60) Continuation of application No. 12/716,911, filed on Mar. 3, 2010, now Pat. No. 8,157,644, which is a continuation-in-part of application No. 10/916,343, filed on Aug. 10, 2004, now Pat. No. 8,052,517, which is a continuation of application No. 10/389,633, filed on Mar. 13, 2003, now Pat. No. 6,878,063, which is a division of application No. 09/967,337, filed on Sep. 28, 2001, now Pat. No. 6,575,832.

(51) Int. Cl.
*G07F 17/32* (2006.01)

(52) U.S. Cl.
USPC ..... 463/25; 463/16; 463/20; 463/29

(58) Field of Classification Search
USPC ..... 463/16, 20, 25
See application file for complete search history.

(56) References Cited

U.S. PATENT DOCUMENTS 5,169,319 A 12/1992 Potocki
5,217,224 A 6/1993 Sincock (Continued)

FOREIGN PATENT DOCUMENTS

GB 2211975 7/1989
NZ 500706 4/2000

(Continued)

OTHER PUBLICATIONS

Office Action dated Jan. 21, 2004 issued in U.S. Appl. No. 10/389,633 [Patent 6,878,063].

(Continued)

*Primary Examiner* — Omkar Deodhar
(74) *Attorney, Agent, or Firm* — Foley & Lardner LLP

(57) ABSTRACT

Disclosed is a gaming system for awarding a bonus to a player of a wager-based game of chance. The gaming system includes one or more gaming devices in communication with one or more host devices over a network. The host device(s) are configured to: i) receive an indication of a bonus award to be provided to a player of the gaming device, ii) receive a selection parameter, and iii) select one of a plurality of weighted pay tables stored in a storage medium using the selection parameter. Each weighted pay table includes a plurality of awards and a plurality of probabilities. The host device(s) are further configured to: iv) randomly determine one of the plurality of awards in the selected weighted pay table in accordance with the plurality of probabilities, and v) provide the randomly determined award as the bonus award for the player.

20 Claims, 17 Drawing Sheets

(56) References Cited

U.S. PATENT DOCUMENTS

| | | | | |
|---|---|---|---|---|
| 5,370,306 | A | 12/1994 | Schulze et al. | |
| 5,370,399 | A | 12/1994 | Liverance | |
| 5,465,982 | A | 11/1995 | Rebane | |
| 5,533,727 | A | 7/1996 | DeMar | |
| 5,655,961 | A | 8/1997 | Acres et al. | |
| 5,752,882 | A | 5/1998 | Acres et al. | |
| 5,766,075 | A | 6/1998 | Cook et al. | |
| 5,816,918 | A | 10/1998 | Kelly et al. | |
| 5,910,048 | A | 6/1999 | Feinberg | |
| 5,941,770 | A | 8/1999 | Miers et al. | |
| 6,012,983 | A | 1/2000 | Walker et al. | |
| 6,048,269 | A | 4/2000 | Burns et al. | |
| 6,113,495 | A | 9/2000 | Walker et al. | |
| 6,126,542 | A | 10/2000 | Fier | |
| 6,174,237 | B1 | 1/2001 | Stephenson | |
| 6,183,362 | B1 | 2/2001 | Boushy | |
| 6,193,608 | B1 | 2/2001 | Walker et al. | |
| 6,196,918 | B1 | 3/2001 | Miers et al. | |
| 6,227,972 | B1 | 5/2001 | Walker et al. | |
| 6,231,445 | B1 | 5/2001 | Acres | |
| 6,244,958 | B1 | 6/2001 | Acres | |
| 6,254,482 | B1 | 7/2001 | Walker et al. | |
| 6,280,328 | B1 | 8/2001 | Holch et al. | |
| 6,319,125 | B1 | 11/2001 | Acres | |
| 6,377,669 | B1 | 4/2002 | Walker et al. | |
| 6,497,408 | B1 | 12/2002 | Walker et al. | |
| 6,575,832 | B1 | 6/2003 | Manfredi et al. | |
| 6,626,758 | B1 | 9/2003 | Parham et al. | |
| 6,712,695 | B2 | 3/2004 | Mothwurf et al. | |
| 6,878,063 | B2 | 4/2005 | Manfredi et al. | |
| 7,291,068 | B2 | 11/2007 | Bryant et al. | |
| 8,157,644 | B2 * | 4/2012 | Boyd et al. | 463/25 |
| 2002/0013726 | A1 | 1/2002 | Wendkos | |
| 2002/0151359 | A1 | 10/2002 | Rowe | |
| 2002/0187834 | A1 | 12/2002 | Rowe et al. | |
| 2003/0032474 | A1 | 2/2003 | Kaminkow | |
| 2003/0176219 | A1 | 9/2003 | Manfredi et al. | |
| 2005/0009601 | A1 | 1/2005 | Manfredi et al. | |
| 2007/0117623 | A1 | 5/2007 | Nelson et al. | |
| 2008/0076531 | A1 | 3/2008 | Baerlocher et al. | |
| 2010/0081497 | A1 | 4/2010 | Wolf et al. | |

FOREIGN PATENT DOCUMENTS

| | | |
|---|---|---|
| NZ | 330189 | 7/2000 |
| WO | WO 00/38089 | 6/2000 |
| ZA | 98/3158 | 10/1999 |

OTHER PUBLICATIONS

Final Office Action dated May 27, 2004 issued in U.S. Appl. No. 10/389,633 [Patent 6,878,063].
Notice of Allowance dated Aug. 9, 2004 issued in U.S. Appl. No. 10/389,633 [Patent 6,878,063].
Office Action dated Dec. 18, 2006 issued in U.S. Appl. No. 10/916,343.
Office Action dated Jun. 7, 2007 issued in U.S. Appl. No. 10/916,343.
Office Action dated Dec. 13, 2007 issued in U.S. Appl. No. 10/916,343.
Final Office Action dated Aug. 4, 2008 issued in U.S. Appl. No. 10/916,343.
Advisory Action dated Jan. 6, 2009 issued in U.S. Appl. No. 10/916,343.
Office Action dated Feb. 23, 2009 issued in U.S. Appl. No. 10/916,343.
Final Office Action dated Oct. 13, 2009 issued in U.S. Appl. No. 10/916,343.
Office Action dated Feb. 1, 2010 issued in U.S. Appl. No. 10/916,343.
Final Office Action dated Jul. 7, 2010 issued in U.S. Appl. No. 10/916,343.
Advisory Action dated Aug. 9, 2010 issued in U.S. Appl. No. 10/916,343.
Office Action dated Jan. 3, 2011 issued in U.S. Appl. No. 10/916,343.
Final Office Action dated Apr. 28, 2011 issued in U.S. Appl. No. 10/916,343.
Notice of Allowance dated Sep. 20, 2011 issued in U.S. Appl. No. 10/916,343.
Office Action dated Apr. 20, 2011 issued in U.S. Appl. No. 12/716,911.
Interview Summary dated Aug. 17, 2011 issued in U.S. Appl. No. 12/716,911.
Notice of Allowance and Allowability dated Oct. 6, 2011 issued in U.S. Appl. No. 12/716,911.
Notice of Allowance and Allowability dated Dec. 29, 2011 issued in U.S. Appl. No. 12/716,911.
Allowed Claims dated Dec. 29, 2011 issued in U.S. Appl. No. 12/716,911.

* cited by examiner

Base Reward: 10 Credits

300

| Multiplier | Probability |
|---|---|
| 100 | 2% |
| 20 | 5% |
| 5 | 10% |
| ⋮ | ⋮ |
| 1.5 | 20% |
| 1 | 25% |
| Expected Value: A | |

*FIG. 15*

400

| Show Tickets (in pairs) | Probability |
|---|---|
| 1st Row, Center | 1% |
| 2nd Row, Center | 2% |
| 5th Row, Stage Left | 5% |
| 10th Row, Center | 5% |
| ⋮ | |
| Balcony | 20% |
| | |

*FIG. 16*

APPARATUS AND METHODS FOR IMPLEMENTING BONUSES IN GAMING MACHINE NETWORKS USING WEIGHTED PAY TABLES

RELATED APPLICATION DATA

This application is a continuation of and claims priority to U.S. patent application Ser. No. 12/716,911, filed on Mar. 3, 2010 and entitled, "APPARATUS AND METHODS FOR IMPLEMENTING BONUSES IN GAMING MACHINE NETWORKS USING WEIGHTED PAY TABLES," which is a continuation-in-part of U.S. patent application Ser. No. 10/916,343, filed on Aug. 10, 2004 and entitled, "METHOD FOR IMPLEMENTING PLAY AT GAMING MACHINE NETWORKS USING PLAYER RATING," now issued as U.S. Pat. No. 8,052,517, issued on Nov. 8, 2011, which is a continuation of U.S. patent application Ser. No. 10/389,633, filed on Mar. 13, 2003 and entitled, "METHOD FOR IMPLEMENTING SCHEDULED RETURN PLAY AT GAMING MACHINE NETWORKS," now issued as U.S. Pat. No. 6,878,063, issued on Apr. 12, 2005, which is a divisional of U.S. patent application Ser. No. 09/967,337, filed on Sep. 28, 2001 and entitled, "METHOD FOR IMPLEMENTING SCHEDULED RETURN PLAY AT GAMING MACHINE NETWORKS," now issued as U.S. Pat. No. 6,575,832, issued Jun. 10, 2003, all of which are hereby incorporated by reference in their entirety into the present application for all purposes.

BACKGROUND

1. Field of the Invention

The present invention relates to gaming machine networks, and more particularly to a method for implementing incentives for players of such gaming machines to encourage play of the gaming machines.

2. Description of the Related Art

Linking together electronic slot machines on a computer network is known in the art. One example of such a network is disclosed in U.S. Pat. No. 5,572,882 to Acres et al. ("the '882 patent"), which is assigned to IGT, the assignee of the present application. The '882 patent is hereby incorporated by reference in its entirety for all purposes. The '882 patent also discloses a number of different bonuses, which pay awards to players at their respective slot machines that are over and above any winnings of slots and other games that are dictated by the pay tables of the machines.

One such bonus award is paid randomly to one of the players via that player's slot machine. Once a slot machine is selected for this type of award, a computer on the network transmits a command to the slot machine that causes it to pay a predetermined amount from the hopper of the machine to the player.

Another type of award is personal to each player and is based on the level of that player's play. As discussed in the '882 patent, a player may be issued a player-tracking card that is insertable into a card reader associated with each slot machine. The network collects data relating to the player's play and stores it in a central computer. Personal awards to the player may be a predetermined amount or a percentage of the player's total play. They are awarded upon the occurrence of a predetermined event, e.g., when the player's cumulative wagers exceeds a predetermined level.

Player tracking points is another award sometimes given to players of networked gaming devices. Each player who uses their card accrues a predetermined number of points for each dollar wagered on the networking gaming machines. Some systems award points for jackpots won on the machines. In any event, the player is eligible to redeem his or her points for complimentary meals, merchandise, or other awards determined by the casino that operates the slot machines. In addition to point accrual based on play, points are often awarded to induce players to sign up for carded play.

In still another effort to induce play on machines, casinos sometimes provide a player with the ability to make complimentary wagers, or to make half price wagers. An example of the foregoing incentives implemented on networked slot machines are disclosed in U.S. Pat. No. 6,244,958 for Method for Providing Incentive to Play Gaming Devices Connected by a Network to a Host Computer to Acres ("the '958 patent"), which is assigned to the assignee of the present application. The '958 patent is hereby incorporated by reference in its entirety for all purposes.

A concern of the gaming casinos operating the games is the overhead cause by unused machines. As casinos are generally located at resort locations, the frequency of play on particular machines is more popular at some times than others. Off-peak days hours, that is periods during which there is low play of the machines, typically occur on Mondays, Tuesdays and Thursdays. Off-peak hours during those days typically occur in the midmornings (that is, after 4 am) but could also occur during times where other events around the casino (such as shows, meals, etc.) attract customers away from the gaming machines. Casino operators are generally interested in driving customers to play during these time periods to increase play throughout the casino.

Another desire for casino operators is to attract higher quality customers to the casino. Although it is known to grant frequent, well-known, or high-rolling players extra benefits for visiting the casino, such as complementary tickets, rooms, and shows, the competitiveness of the casino industry requires that something more be contemplated.

SUMMARY

Aspects of the present invention provide a gaming system that may be provided in a gaming venue associated with a casino or across a gaming enterprise. The gaming system may comprise a number of gaming devices such as gaming machines and table games that are distributed throughout the gaming environment.

One aspect of the present invention provides a gaming system for awarding a bonus to a player of a wager-based game of chance. The gaming system includes one or more gaming devices configured to play games of chance. The gaming device includes an input mechanism configured to receive an indication of a wager, and an output mechanism configured to output a winning for play of the games. The gaming system further includes one or more host devices in communication with the gaming devices over a network. The host device(s) includes a processor configured to: i) receive an indication of a bonus award to be provided to a player of the gaming device, ii) receive or retrieve a selection parameter, iii) select one of a plurality of weighted pay tables stored in a storage medium using the selection parameter, each weighted pay table including a plurality of awards and a plurality of probabilities, each award having an associated one of the probabilities, iv) randomly determine one of the plurality of awards in the selected weighted pay table in accordance with the plurality of probabilities, and v) provide the randomly determined award as the bonus award for the player. Generally, each weighted pay table has an expected value (EV), which can be determined and adjusted by an operator of the gaming establishment.

In some implementations, the randomly determined award can be provided over the network to the gaming device, for instance, where the player is located. The randomly determined award can also be provided over the network to an output device situated at a remote location with respect to the gaming device, for instance, at a kiosk or further gaming device. The bonus award can also be configured to be redeemable at a remote location with respect to the gaming device, for instance, at a table game.

In one embodiment, the selection parameter can indicate one of a plurality of player levels associated with the player. The selection parameter can be used to select a weighted pay table corresponding to the indicated player level. In another embodiment, the selection parameter can indicate one of a plurality of player ranks associated with the player. The selection parameter can be used to select a weighted pay table corresponding to the indicated player rank. In some implementations, such player level and player rank data can be retrieved from a player tracking server or other suitable storage facility where such player data is maintained and updated.

Examples of suitable selection parameters used in accordance with embodiments of the present invention include: a time of play, a date of play, an event associated with play, a time of redemption, a day of redemption, and an event associated with redemption. Further examples include: theoretical win, frequency of visit, amount played per visit, home address, age, sex, designated group, average bet amount, and type of game played. Still further examples include one or more items of player tracking information or player preference information.

In some implementations, the random determination of one of the plurality of awards as the bonus award can occur responsive to the player qualifying for the bonus award. In other implementations, such determination can occur responsive to the player redeeming the bonus award.

In one embodiment, the system further includes a display configured to display a presentation of the bonus award. The display can be integral with the gaming device operated by the player, in communication with such gaming device, or situated at various locations about the casino floor, for instance over a bank of gaming machines. Examples of a suitable display include a main display, a player tracking display, an information panel, and a secondary display. In one embodiment, the presentation of the bonus award can include an indication of a range of a value of the bonus award. In another embodiment, the presentation of the bonus award can include an indication of a maximum value of the bonus award.

Alternative weighted pay table configurations are provided in accordance with embodiments of the present invention. For instance, a multiplier applied to a base award amount can define one or more of the plurality of awards in a weighted pay table. In another example, the plurality of awards in the weighted pay table can be non-cash awards.

According to another aspect of the present invention, a bonus award device is configured to award a bonus to a player of one or more wager-based games of chance. The bonus award device can be implemented as a gaming device, a kiosk, or other suitable data processing apparatus, such as a data processing unit associated with a table game. The bonus award device includes an I/O mechanism configured to receive a portable medium such as a ticket or data card and read information on the portable medium indicating a bonus award to be provided. The device further includes a controller operably configured to: i) receive a selection parameter responsive to reading the information indicating the bonus award to be provided, ii) select one of a plurality of weighted pay tables stored in a storage medium using the received selection parameter, each weighted pay table including a plurality of awards and a plurality of probabilities, each award having an associated one of the probabilities, iii) randomly determine one of the plurality of awards in the selected weighted pay table in accordance with the plurality of probabilities, and iv) provide the randomly determined award as a bonus award for the player. The bonus award device further includes a display configured to display a presentation of the bonus award.

Yet another aspect of the present invention includes a method for awarding a bonus to a player of a gaming device configured to play one or more games of chance responsive to an indication of a wager. The method includes: receiving an indication of a bonus award to be provided to a player of the gaming device; receiving a selection parameter; selecting one of a plurality of weighted pay tables stored in a storage medium using the received selection parameter, each weighted pay table including a plurality of awards and a plurality of probabilities, each award having an associated one of the probabilities; randomly determining one of the plurality of awards in the selected weighted pay table in accordance with the plurality of probabilities; and providing the randomly determined award as a bonus award for the player.

Another aspect of the invention described herein relates to a method for customizing play of a gaming device according to a particular player level or group. The gaming device is connected by a network to a host computer and includes creating a player account accessible by the host computer. The player account is associated with a player and has stored therein one of a plurality of player levels. The player is allowed to play on the gaming device and the gaming device is operated responsive to the player level. That is, the step of operating the gaming device includes adjusting a bonus triggering threshold and/or quantitative amount awarded based on the player level. In this way, high rated players such as those that gamble frequently and in high amounts, have gaming and bonusing events and award amounts tailored to their style of play and preferences to encourage continued play.

Another aspect of the invention pertains to computer program products including a machine-readable medium on which are stored program instructions for implementing any of the methods described above. Any of the methods of this invention may be represented as program instructions and/or data structures, databases, etc. that can be provided on such computer readable media.

In certain embodiments the devices and methods described herein include, but are not limited to any combination of two or more, three or more, or four or more, of the elements or features described above and/or any combination of two or more, or three or more, or four or more of the elements or features described herein.

Aspects of the invention may be implemented by networked gaming machines, game servers and other such devices. These and other features and benefits of aspects of the invention will be described in more detail below with reference to the associated drawings. In addition, other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive systems and methods for enabling secure transactions on a gaming machine. These drawings in no way limit any changes in form and detail that may be made to the invention by one skilled in the art without departing from the spirit and scope of the present invention.

FIG. 15 shows a weighted pay table 300 constructed according to another embodiment of the present invention.

FIG. 16 shows a weighted pay table 400, constructed according to another embodiment of the present invention.

DETAILED DESCRIPTION

Exemplary applications of systems and methods according to the present invention are described in this section. These examples are being provided solely to add context and aid in the understanding of the present invention. It will thus be apparent to one skilled in the art that the invention may be practiced without some or all of these specific details. In other instances, well known process steps have not been described in detail in order to avoid unnecessarily obscuring the present invention. Other applications are possible, such that the following example should not be taken as definitive or limiting either in scope or setting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

Although the present invention is directed primarily to gaming machines and systems, it is worth noting that some of the apparatuses, systems and methods disclosed herein might be adaptable for use in other types of devices, systems or environments, as applicable, such that their use is not restricted exclusively to gaming machines and contexts. Such other adaptations may become readily apparent upon review of the inventive apparatuses, systems and methods illustrated and discussed herein.

Figure 1:
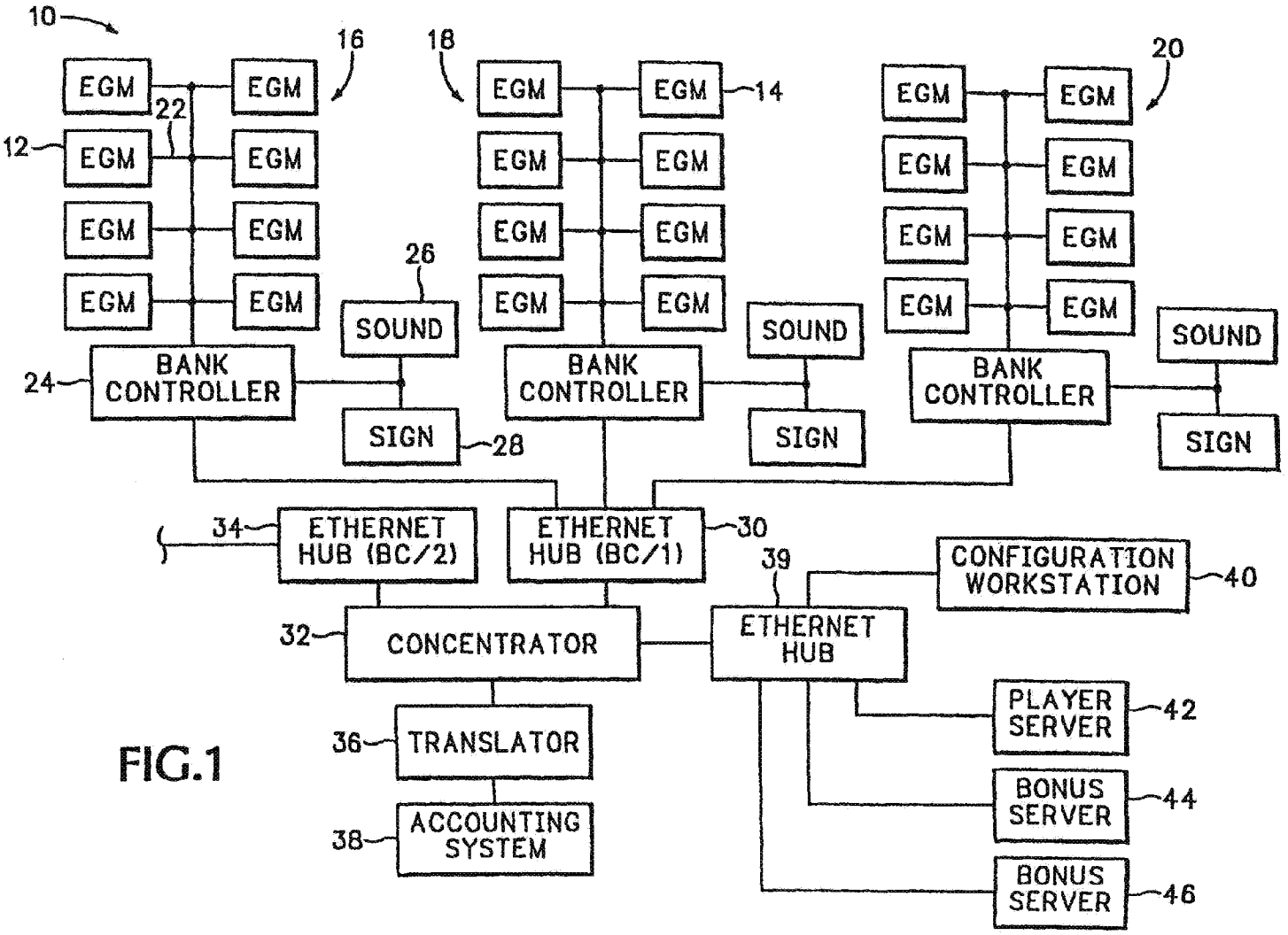
FIG. 1 is a schematic diagram of a plurality of electronic gaming machines interconnected by a computer network to a host computer in accordance with one embodiment of the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, and 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. In the present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network. A program operating on configuration workstation 40 enables a casino operator to configure criteria for certain bonusing events running on bonus servers 44, 46 using a graphic user interface such as that shown in FIGS. 3-12. Criteria set to operate a bonusing scheme of the present invention include such features as a calendar for setting earning and redemption time periods, earning tables, multipliers, player payments adjusted for player ranking, level or group, message working, pool names, etc.

The player server 42 comprises a microcomputer that is used to control messages that appear on displays associated with each EGM. Player server 42 includes an Intel Pentium Processor and an Ethernet card. The player server comprises a database coupled to the bonusing system shown in FIG. 1 that stores all points and credits accumulated by the player according to player ID number, including earned credits, redeemed credits, player points, etc.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in co-owned U.S. Pat. No. 6,319,125 (the '125 patent), which is incorporated herein by reference for all purposes. This co-owned patent also describes in more detail features of the network, like that shown in FIG. 1, that may be used to implement the present invention. The '882 patent also discloses bonuses that can be implemented by bonus servers 44, 46 and a network that could be used to implement the present invention.

Figure 2:
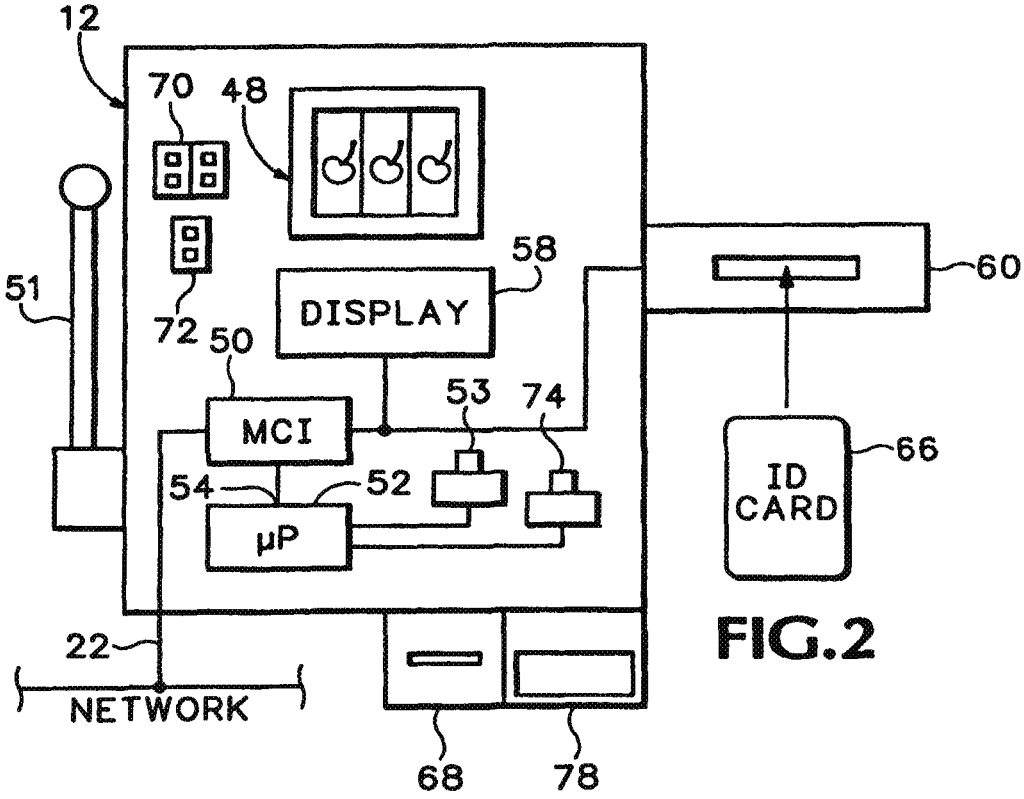
FIG. 2 is a schematic diagram of a slot machine and associated hardware implemented in accordance with one embodiment of the present invention.

FIG. 2 is a highly schematic representation of an electronic slot machine—typical of each of the machines in the network—that incorporates network communications hardware as described hereinafter. This hardware is described in the '882 patent, and is referred to therein as a data communications node. Preferably the network communications hardware is like that disclosed in the '125 patent, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected. It is possible for the MCI to be fitted with a microprocessor so that all functions of the machine are controlled by the MCI.

Included in EGM 12 are three reels, indicated generally at 48. Each reel includes a plurality of different symbols thereon. The reels spin in response to a pull on handle 51 or actuation of a spin button 53 after a wager is made. It will be appreciated that the bonus scheme taught in the present invention is not dependent upon the type of game played at the three, four, or five reel slots, poker, video blackjack, or other type of game can be played according to the bonus scheme presented.

MCI 50 includes a random access memory (RAM), which can be used as later described herein. The MCI also facilitates communication between the network and a vacuum florescent display (VFD) 58, a card reader 60, a player-actuated push button 62, and a speaker 64. The VFD 58 includes display elements and memory and its operation is well known in the art and thus not described further here. Various messages specified within the configuration workstation 40 during bonus scheme setup and stored within the bonus servers 42, 44 are uploaded to the MCI 50 and forwarded for storage in the VFD memory. The MCI causes various messages to be displayed on the VFD 58 upon the occurrence of specified events tracked by the MCI responsive to play on the EMG 12 by sending a signal to the VFD reflective of a message ID number. The memory within the VFD cross-references the message number to identify and then display the selected message on the display to the player.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed a single credit transfers to the coin-in meter up to a maximum bet that can be placed on a single play of the machine. In addition, a maximum-bet button (also not shown) may be provided to immediately transfer the maximum number of credits that can be wagered on a single play from the credit meter 70 to the coin-in meter 72. It is understood that some machine would be able to utilize the VFD 58 to display all such information instead of numeric displays 70, 72 and that the actual display mechanism used is not important to the general implementation of the invention.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '882 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won (e.g. level of play) and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

Before describing the manner in which the present invention is implemented on the network of slot machines depicted in FIG. 1, consideration will first be given to terminology used in the description.

First, a player-tracking account is one that is established by the casino, typically for an identified player—although the invention could be implemented with an anonymous account. The player-tracking account is referred to herein as a player account. When the player inserts his or her card into card reader 60 of EGM 12, information related to that player's account is fetched from the host computer, transmitted on the network, and stored in the RAM included in MCI 50 of EGM 12. Such information includes player-tracking points, which are referred to generally herein as account points. In accordance with the present invention, the player's account may also include credits that may be transferred by the player from the player's account to credit meter 70 on the machine and thereafter wagered by the player. These credits in the player's account are referred to herein as account credits and are awarded and redeemed as described hereinafter. Credits appearing on credit meter 70 of EGM 12 are referred to herein as meter credits.

As used herein the term jackpot indicates an award made resulting from the pay table on one of the EGMs while the term bonus indicates an award that does not result from the machine's pay table. The '125 patent and '882 patent include many examples of bonuses. The term award is intended to encompass any payment given to a player of one of the EGM's and includes both jackpots and bonuses. The term base credits is the term used to signify the bonus granted to a base player ("level 1") depending upon that player's level of play—that is, how much that player has wagered over the period being tracked. The term earned credits signifies the bonus stored within the player account at the player server 42 in consideration of that player's actual player level—that is, the base credits amount multiplied by the earned credit multiplier. As will be appreciated in the description included further below, earned credits are not yet available for play until the redemption period. The earned credit multiplier is a number between 1 and 10 and is typically a higher value for higher level players. In this way, higher level (e.g. more desirable) players are encouraged to play more often at the casino by receiving a higher bonus award for a certain level of play. The term redeemed credits signifies the credits actually available for play by the player on a gaming machine during the redemption period. The number of redeemed credits is calculated according to a preferred embodiment of the invention by multiplying the number of earned credits in the player account by a redeem credit multiplier value, set by the gaming operator to encourage players to play at certain times. Once redeemed credits are played at the gaming machine, they are considered played credits.

One way in which account credits may be applied to a player's account is as an incentive to open the account. In other words, when the account is opened by the casino, an account credit, e.g., $5, is applied to the account. The following Table 1, which is described in more detail below, sets forth the sequence followed by the player to redeem the account credits for play on EGM 12.

TABLE 1

| |
|---|
| 1. Player account information, including account credits and points, is stored in MCI 50 RAM responsive to insertion of card 66 into reader 60. |
| 2. Player places wager by inserting bill into bill acceptor 68 or coin into the coin acceptor (not shown). |
| 3. Player plays game by pushing spin button 53. |
| 4. Responsive to play, the account credits are automatically debited in the amount of the wager and applied to credit meter 70. |
| 5. Steps 3 and 4 are repeated so long as the player wishes to play. |
| 6. When the player is finished playing, he or she pushes cash-out button 74 and withdraws card 66 from reader 60. |

When the player inserts card 66 into reader 60, the account information is fetched from the host computer in step 1 above. The amount of account credit available appears on display 58 in the denomination of the machine being played. In the example above, with an initial account credit in the amount of $5, when the card is inserted into a nickel slot machine display 58 shows: Account Credit=100. If the player was using a dollar slot machine, display 58 would show: Account Credit=5.

When a player account is accessed responsive to insertion of the player's card, the host computer prevents the account from being accessed from another slot machine. This blocks the use of a duplicate card to load the account into a second machine after the account information has already been fetched from the host computer and loaded into a first machine. This can be accomplished in a manner similar to that used to prevent a document from being loaded into a word processor operating on two different computers on a network. In other words, after the document is loaded, it is locked out from being loaded into a second word processor on the network.

In steps 2 and 3, the player places a wager, for example, in the amount of $0.15 via the coin acceptor and presses spin button 53 to play the game. If the player deposits coins or bills, via bill acceptor 68, in excess of the amount wagered, the balance appears on credit meter 70. But in the present example, assume that the wager is made via the coin acceptor and that there is a zero balance on the credit meter after the wager is applied to coin-in meter 72 and before the player pushes spin button 53.

When the player presses the spin button, the reels begin to spin. Also in response to pressing the spin button, coin-in meter 53 goes to zero, the account credits are debited by 3 (the amount of the wager in the number of coins applied to coin-in meter 72), and credit meter 70 is credited by 3—effectively restoring the player's initial wager. Display 58 now shows: Account Credit=97, credit meter 70 now shows a balance of 3, and the player has had a free game.

It should be appreciated that the credit applied to the meter after the reels spin, could be in amounts other than a one-to-one ratio. That is, instead of matching each credit bet with a credit applied to the credit meter, the casino could choose to award, e.g., a half credit for each credit bet, or could make the award greater, e.g., two credits applied to the credit meter for each credit bet. The present embodiment, however, is described with a matching credit applied to the credit meter for each credit bet.

The player may, if he or she so chooses, redeem the meter credits by depressing cash-out button 74, or may continue to play. Assume that the player elects to wager 2 credits on the next game. The player depresses the coin-in button (not shown) to transfer 2 credits from credit meter 70 to coin-in meter 72. Credit meter 70 then shows a balance of 1 and coin-in meter displays 2. When spin button 53 is depressed to play the game, 2 more credits are deducted from the account credits and added to credit meter 70. After the game, display 58 shows: Account Credit=95. And credit meter 70 shows a balance of 3, 1 credit remaining from before the game and 2 added from the account credits responsive to the play.

Assume this game resulted in a 10-coin win based on the pay table in EGM 12. This win is applied to credit meter 10, which now shows a balance of 13. The player may again decide to cash out and thus retrieve the 10 coin win and the initial 3 coin investment. All 5 credits wagered came from the account credits, which now has a 95 credit balance.

With this system, the player must wager each account credit he or she wishes to cash out. In other words, the player cannot cash out the account credits without wagering them. All awards, whether from jackpots or bonuses, are applied to credit meter 70. When the player finishes wagering, he or she cashes out and removes his or her card. When the player wishes to resume wagering, on EGM 12 or on any other of the EGM's connected to the network of FIG. 1, the card is again inserted into the card reader, like reader 66, associated with the EGM played by the player. The display shows: Account Credit=95. And the player must again use their own money, recovered from cashing out at the last machine, to initiate the wagers.

Account credits can be applied by the casino to a players account as a player-tracking sign-up award, as in the example above. In addition, the casino might credit the account for a special date such as a birthday, an anniversary, etc., and send mail to the player notifying him or her of this credit.

Another promotion is described in the '125 patent and is referred to therein as Welcome Back. In that promotion, a player who earns a predetermined minimum number of account points has their account credited for half-priced wagering as described in the '125 patent. This encourages the player to return to the casino at a later time. This award could be made in account credits that are redeemed as described in the present application. The present invention is an expansion of this concept to drive players to not only return to the casino but to return at specific times.

Similarly, any of the bonus awards described in the '882 patent or in the '125 patent could be made in account credits rather than being applied directly to the credit meter. For example, some random awards are funded by placing a preselected percentage of wagers made into a bonus pool. The wagers may be made either on a preselected group of machines or by a single identified, player playing on different machines. The group is preselected by the casino at workstation 40 with the host computer accounting for the bonus pool for that group, as well as other groups of machines. Such a preselected group is referred to as a link. After a minimum amount is accrued in the bonus pool, the pool, or a portion thereof, is awarded at random to an eligible player. Such awards, rather than being paid to the credit meter, could be in the form of account credits that must be redeemed as described above.

Another bonus award that could be made in account credits occurs when a big win is won. For example, assume that one of the slot machines pays a large amount, defined by the casino as being over a predetermined amount. This big win could be a result of a jackpot, dictated by the machine's pay table, or as a result of one of the random or other bonuses that does not result from the machines pay table.

When a big win occurs, all the same machines on the link (or all the machines on the network) can be paid a bonus, either in the form of a credit to the credit meter or as account credits or points. Such a bonus can be programmed at the host computer to occur responsive to the big win. The casino can impose eligibility criteria for awarding this bonus, such as a predetermined rate or level of play. In addition, the casino can also condition that such bonuses be paid only to carded players as a further incentive to enroll players in the player-tracking system. On the other hand, awards could still be made to uncarded players but carded players could give larger awards, also as an incentive to register for and use a player-tracking card. The big-win award is made to all of the players on the link by crediting the RAM in each MCI 50 on the link with a predetermined amount of account credit. Uncarded players therefore receive the same credit as a carded player. The uncarded player must, however, use all of the account credits on the machine to which the award is made. Thus, applying credit to a player's account may be done manually by the casino at a keyboard when, e.g., the player signs up for carded play. This credit is applied to the player's account on the host computer. As described above, the credit may also be applied to either a carded or uncarded player by awarding account credits over the network directly to the RAM in MCI 50 in the player's EGM.

The big-win award could be in a predetermined amount of money (in account credits) or as a multiple of the player's last wager. Alternatively, the award could be in account credits, e.g., 5 credits. A player on a $1 machine would get a $5 account credit and a player on a quarter machine would receive a $1.25 account credit.

Finally, big-win awards have an expiration time. If button 62 is not pressed within a predetermined number of seconds after the award is made, it expires and will not be granted. This prevents a nonplayer from collecting an award at a machine that a player has just walked away from. Display 58 coupled with audible signals from speaker 64 clearly indicates to the player the need to press button 62 to collect the prize.

Another important feature of the present invention involves the accumulation of earned credits and the conversion of earned credits to redeemed credits at the slot machine and without involvement of casino personnel. The following Table 2, which is described in more detail below, sets forth the sequence followed by the player to convert account points to account credit at EGM 12.

TABLE 2

| |
|---|
| 1. Player account information, including earned credits and points, is stored in MCI 50 RAM responsive to insertion of card 66 into reader 60. |
| 2. Display 58 displays account points and player accumulates additional earned credits from play during earn credit periods until card 66 removed from reader 60. |
| 3. Upon insertion of card 66 into reader 60 during a redeem credit time period, all accumulated earned credits are converted to redeemed credits, which now appear on display. |
| 4. Player places wager by inserting bill into bill acceptor 68, coin into the coin acceptor (not shown), or uses credits available from credit meter 70. |
| 5. Player plays game by pushing spin button 53. |
| 6. Responsive to play, the redeemed credits are automatically debited in the amount of the wager and applied to credit meter 70. |
| 7. Steps 5 and 6 are repeated so long as the player wishes to play. |
| 8. When the player is finished playing, he or she pushes cash-out button 74 and withdraws card 66 from reader 60. |

When the player inserts card 66 into reader 60, the account information is fetched from the host computer in step 1 above. In step 2, the amount of earned credits accrued appears on display 58. In the present example, assume the casino awards one earned credit for every $0.01 wagered during the earning time period specified within the configuration workstation 40. A player having wagered $50 has consequently accrued 5,000 earned credits, which is the number appearing on display 58. Further play during this or another earning time period within the bonus period results in accumulation of additional earned credits.

The preferred implementation of the invention operates to award players bonuses for reaching certain playing milestones. Accordingly, one award would be given for betting $100 and another $200, with the player receiving prompt messages to induce the player to play enough to reach the next bonus level.

In step 3, the player has returned to the gaming machine at a later time during which a redemption time period is active and inserts his card 66 into reader 60, thereby converting his or her earned credits to redeemed credits. Redeemed credits are converted for use on the particular gaming machine. Assuming the EGM is a dollar machine, display 58 consequently shows the number of redeemed credits available for play on the dollar machine to be 50.

Steps 4 through 8 occur in the same manner as described for steps 2 through 6 in the example associated with Table 1. In other words, redeemed credits are debited after each play in the amount of the wager with that amount being also credited on the credit meter. All awards, whether from jackpots or bonuses, are applied to the credit meter.

In step 8, when the player is finished playing, he or she may cash out any amount on credit meter 70 by pushing cash-out button 74 and withdraw card 66 from reader 60. When the player next inserts the card into one of the card readers on the network, the balance in credits appears in display 58.

Unused redeemed credits are always stored as points when the player logs out. For example, assume the player has 5,000 points and converts them to 50 account credits. The player then plays down to 42 account credits and when he or she logs out, the account balance shows 4,200 points. On the other hand, if the player converts the 5,000 points to 50 account credits and then receives a big-win prize of 20 account credits, the player's balance is 70 account credits: 50 converted from points, and 20 awarded. If the player logs out after only nine of the account credits are used, the system stores 5,000 account points and 11 account credits in the player's account. When the player next logs on to a machine, the number of account points—5,000—are displayed, and the display then changes to Account credit=11. These credits are used as play proceeds.

In another example, assume the player converts 5,000 points into 50 account credits and plays 8 of the account credits. If an award of 20 account credits is then made, the display indicates 62 account credits, and play continues. If the player then plays down an additional five credits, then logs out, the account has 4,200 points and 15 account credits, the account credits being displayed the next time the player logs in.

The activity described in the preceding examples takes place at the MCI 50 and associated RAM after the player's account information is retrieved from the host computer. When the player logs out, any remaining points or account credits are again stored in the account on the host computer.

With this system, credits are redeemed for additional gaming rather than for merchandise, meals, or the like. The casino would prefer to be providing gaming to players rather than maintaining and dispensing an inventory of noncash items. In addition, the present system prevents a break in gaming. Rather than the player waiting in line to redeem points, the player is on the floor playing the games, which again enables the casino to continue to provide gaming to the player. The player also has the flexibility of converting back and forth between account credits and account points, as he or she chooses. Because the points are converted to account credits rather than to credits on the gaming meter, the player can redeem the credits one wager at a time, i.e., they can not be cashed out at once.

In all embodiments disclosed herein, any jackpots or bonuses won are applied to the credit meter, which the player can cash out or wager as he or she sees fit. In addition, account credits can be applied either at the host computer or locally over the network. The account credits may be applied either manually, responsive to input by casino personnel at a keyboard, or in response to bonus rules that are programmed on the host computer. Finally, it is a significant advantage that this system is implemented with the player tracking card, because many players already have and use one.

Scheduled Return Play

Figure 3:
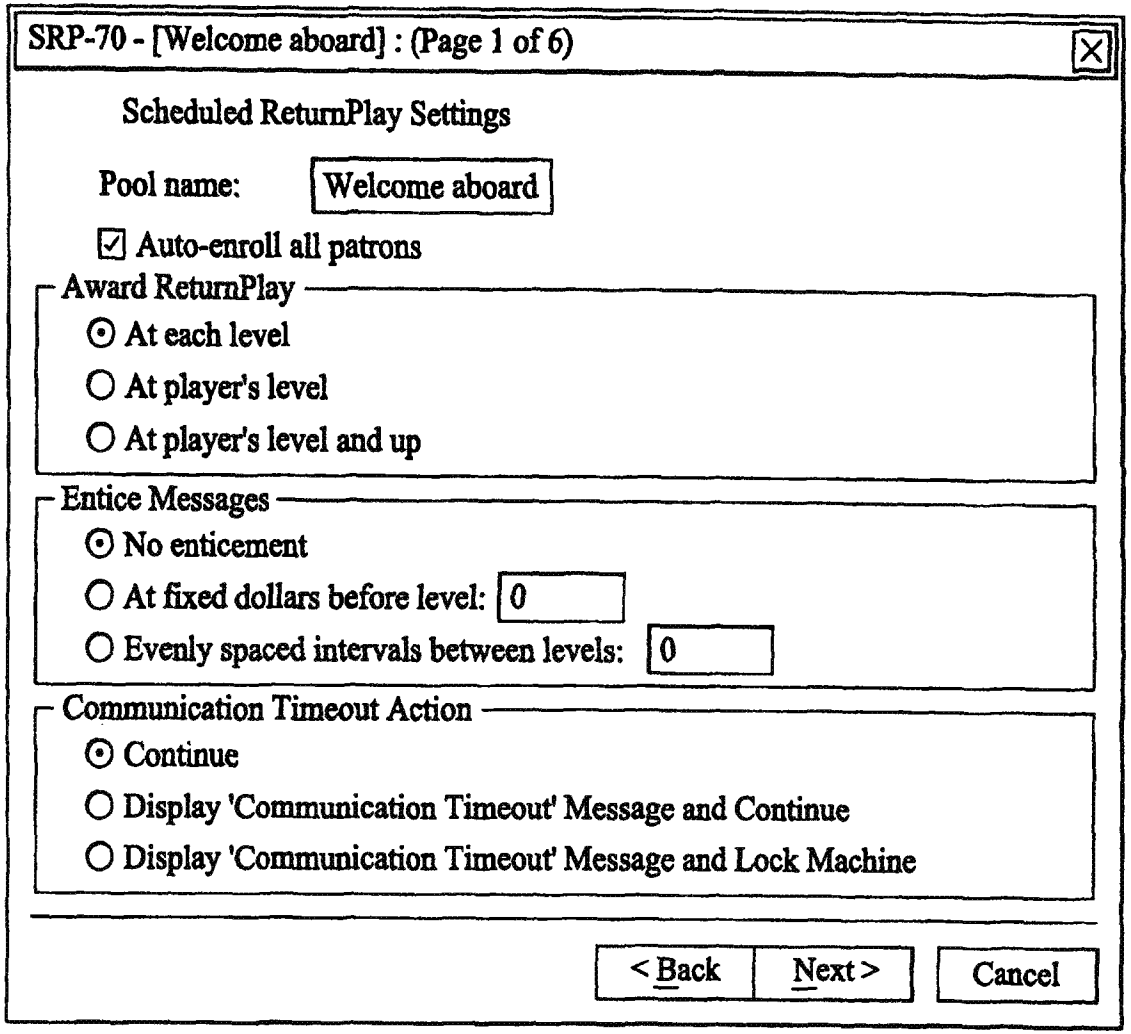
FIGS. 3-12 are screen shots illustrating bonus promotion criteria selected within configuration software operating on the network of FIG. 1, in accordance with one embodiment of the present invention.

Described below is a method for implementing the bonus according to a preferred embodiment of the invention. FIG. 3 illustrates a screen shot of a program operating on the configuration workstation 40 that allows a casino operator to designate operating criteria of the incentive bonus described herein. A description of the operating parameters shown in FIG. 3 is shown in Table 3 below and incorporates the concept of award by player level:

TABLE 3

Scheduled ReturnPlay Main Settings Fields [FIG. 3]

| Field Name | Description |
|---|---|
| Pool Name | Return play promotion pool name. |
| Auto-enroll all patrons | If selected, all patrons are eligible for the promotion. If not selected, patron eligibility is determined by information within player server 42. |
| Award at each level | A player is awarded ReturnPlay for each level they reach. For example, if there was play to the level 5 threshold, the player would get the award for levels 1, 2, 3, 4, and 5. |
| Award at player's level | This is a status symbol version where higher level players are not bothered with smaller awards. For example, a level 5 player would only receive an award when they play to the level 5 threshold. |
| Award at player's level and up | This is a status symbol version where higher level players are not bothered with smaller awards. For example, a level 5 player would receive an award when they play to the level 5 threshold or above. |
| No enticement | No messages are displayed to entice the player to the next tier. |
| At fixed dollars before level | Enables an enticement message at a dollar value before the next level. For example, as a player approaches the threshold for tier 2, the player receives a message "$10.00 play to go before $$$$ reward". The amount before the next level is specified in the edit box. See the examples in section Error! Reference source not found.. |
| Evenly spaced intervals between levels | Enables an enticement message at intervals between levels. For example, if there is $100 between tiers 2 and 3, the player could receive an enticement message at $75, $50, and $25 left to play. The number of entice messages between levels is specified in the edit box. See the examples in section Error! Reference source not found.. |
| Continue | If the bonus server is offline, play continues with no VFD message display. |
| Display "Communication Timeout Action" and Continue | If the bonus server is offline, display the appropriate VFD message and continue play. |
| Display "Communication Timeout" action and Lock Machine | If the bonus server is offline, display the appropriate VFD message and lock machine so further play cannot be continued. |

Players can be grouped by level to signify, for instance, how valued a player is to the gaming casino. The player level can determined based upon one or more of the following criteria:

theoretical win, frequency of visit, time since last visit, amount played per visit, home address, age, sex, average bet amount, and type of game played. Alternately, of course, the casino operator can simply assign a number (e.g. between 1 and 10) within the proper location of the player account record to indicate the player level. As will be appreciated, the gaming machine on which the player plays can be operated responsive to the player level. For instance, the machine can be operated by MCI 50 to display a selected one of certain messages stored in VFD 58 to the player responsive to play on the gaming device and to the player level. Thus, two players, each having a different level from the other, would have displayed to them a different message for identical levels of play. Alternately, the machine can be operated by MCI 50 to award to the player an award based on the player level of the player where the award would be different than one awarded to a different player having a different player level. For instance, lucky coin pools would be determined by player levels and grouping. Also, personal progressive parameters such as minimum and maximum prize amount, increment rate, etc. would be determined by player level or group.

Player grouping is analogous to machine groups. Players can be divided into groups based on historical behavior, demographic characteristics, and personal interests. Bonus eligibility and functionality parameters can be modified based on what groups players fall into. The thought is that bonuses can be tailored to be appealing to each group. Upon player card insertion, the group information is retrieved from the database. The MCI 50 then determines eligibility for bonuses based on group information, and adjusts bonus parameters accordingly. Examples of bonus tables constructed to award players different amounts based on levels are illustrated below.

Figure 4:
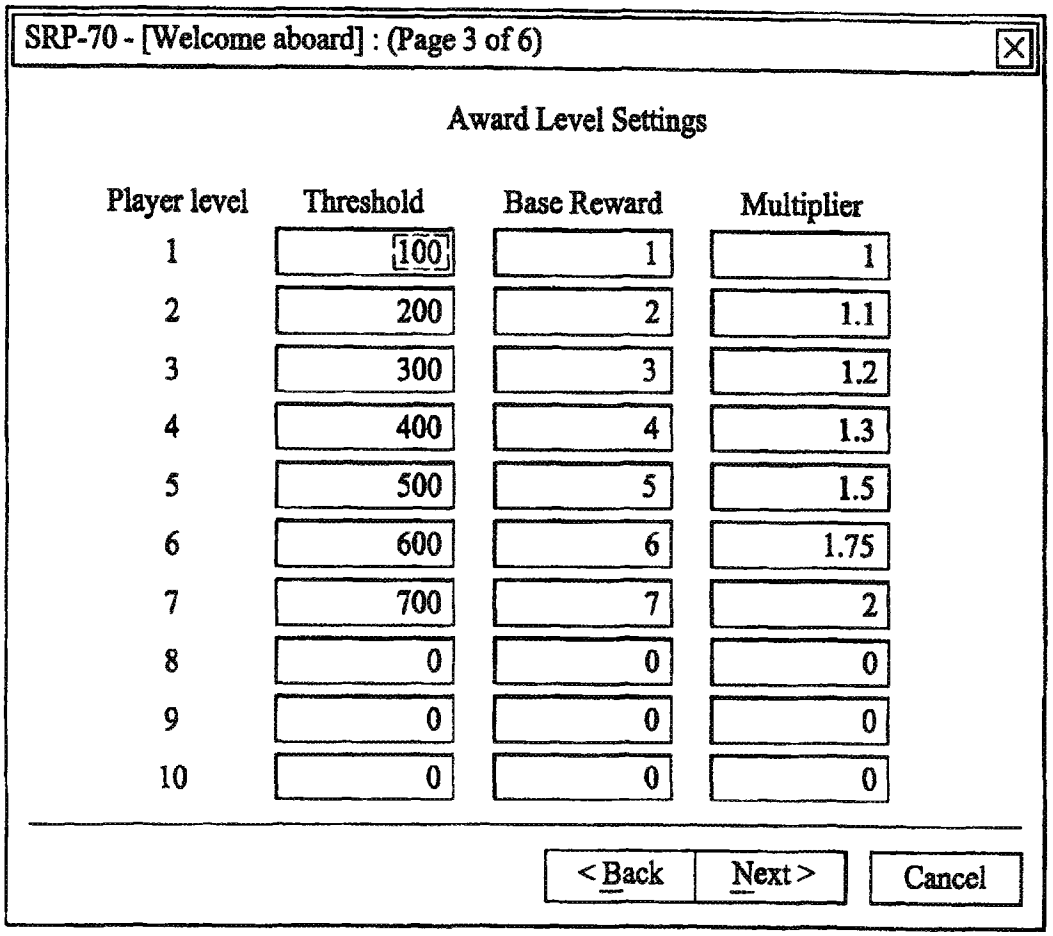

FIG. 4 is a screen shot illustrating the levels where awards are earned, and any multiplier applied to a player's earnings. This table will be used in the examples described further below. A description of the operating parameters shown in FIG. 4 is shown in the table below:

TABLE 4

Award Level Settings Fields [FIG. 4]

| Field Name | Description |
|---|---|
| Player level | Maximum ten player levels. |
| Threshold | Amount of play for required award eligibility. |
| Base Reward | The minimum dollar amount given to a player. |
| Multiplier | A discretionary multiplier applied to the base award for player incentive (earned credit multiplier) |

Any awards given to a player are typically cumulative. For example, using the award level settings illustrated in FIG. 4, if a player receives an award for level 1 and level 2, that player would receive a total earned credit amount of $3 ($1 for level 1 and $2 for level 2). The section below illustrates examples of different game settings (FIG. 3) and how such settings affect play.

The scenarios described below all use the exemplary award level settings shown within FIG. 4. That is:

| Level | Threshold | Base Award | Multiplier |
|---|---|---|---|
| 1 | 100 | 1 | 1.00 |
| 2 | 200 | 2 | 1.10 |
| 3 | 300 | 3 | 1.20 |
| 4 | 400 | 4 | 1.30 |
| 5 | 500 | 5 | 1.50 |
| 6 | 600 | 6 | 1.75 |
| 7 | 700 | 7 | 2.00 |

Each example below includes a table with the amount played and the amount to be awarded to a player at a specific level. The player's level is retrieved from the player server database 42 when the player's card is inserted.

EXAMPLE 1

Award at Each Level

With this type of ReturnPlay bonus selected, the base award for the total amount of play is the amount earned regardless of the level of the player. The following bonus payout award table results from selecting the award "At each level" option in the Scheduled ReturnPlay Main Settings screen (FIG. 3) and using the award level settings shown above and in FIG. 4.

| Amount Played | Level 1 Award | Level 2 Award | Level 3 Award | Level 4 Award | Level 5 Award | Level 6 Award | Level 7 Award |
|---|---|---|---|---|---|---|---|
| $100 | $1.00 | $1.10 | $1.20 | $1.30 | $1.50 | $1.75 | $2.00 |
| $200 | $3.00 | $3.30 | $3.60 | $3.90 | $4.50 | $5.25 | $6.00 |
| $300 | $6.00 | $6.60 | $7.20 | $7.80 | $9.00 | $10.50 | $12.00 |
| $400 | $10.00 | $11.00 | $12.00 | $13.00 | $15.00 | $17.50 | $20.00 |
| $500 | $15.00 | $16.50 | $18.00 | $19.50 | $22.50 | $26.25 | $30.00 |
| $600 | $21.00 | $23.10 | $25.20 | $27.30 | $31.50 | $36.75 | $42.00 |
| $700 | $28.00 | $30.80 | $33.60 | $36.40 | $42.00 | $49.00 | $56.00 |

The advantages of the Award at Each Level scheme is that it is simple to explain to customer, is simple to calculate, that it rewards customer for additional play, that everyone starts at the same level, and that it can award preferred (higher level) patrons more. Note how higher level players achieve a greater earned credit award from lower players with the same level of play. A level 1 player that plays $400 would earn a $10.00 earned credit award; while a level 5 player would earn a $15.00 award from the same amount of play owning to the earned credit multiplier of .times.1.5 set in the award level settings screen of FIG. 4. By setting the multiplier for all levels to 1, however, all players would be awarded the same amount (the Level 1 Award amount).

EXAMPLE 2

Award at Player's Level

With this type of ReturnPlay bonus selected, players have to play to their normal play level to earn an award. Additional play does not earn any additional credit. That is, higher level players might be expected to gamble more money and thus would be awarded only upon reaching higher thresholds than lower level players. The following bonus payout award table results from selecting the award "At player's level" option in the Scheduled ReturnPlay Main Settings screen (FIG. 3) and using the award level settings shown above and in FIG. 4.

| Amount Played | Level 1 Award | Level 2 Award | Level 3 Award | Level 4 Award | Level 5 Award | Level 6 Award | Level 7 Award |
|---|---|---|---|---|---|---|---|
| $100 | $1.00 | $0.00 | $0.00 | $0.00 | $0.00 | $0.00 | $0.00 |
| $200 | $1.00 | $3.30 | $0.00 | $0.00 | $0.00 | $0.00 | $0.00 |
| $300 | $1.00 | $3.30 | $7.20 | $0.00 | $0.00 | $0.00 | $0.00 |
| $400 | $1.00 | $3.30 | $7.20 | $13.00 | $0.00 | $0.00 | $0.00 |
| $500 | $1.00 | $3.30 | $7.20 | $13.00 | $22.50 | $0.00 | $0.00 |
| $600 | $1.00 | $3.30 | $7.20 | $13.00 | $22.50 | $36.75 | $0.00 |
| $700 | $1.00 | $3.30 | $7.20 | $13.00 | $22.50 | $36.75 | $56.00 |

Suppose, for example, that a level 1 player, a level 4 player, and a level 5 player each gamble $400. Earned credits accumulated within the MCI 50 of the EGM 12 for the level 1 player would result in only a $1 award. This award would be transferred to the player server 40 as $1 in earned credits (stored as 100 cents) upon removal of player card 66 from the card reader 60 at EGM 12 and stored within the player account. Earned credits are converted to playable redeemed credits by returning the casino at a later time during a redemption period according to the process described further below. The level 1 player would receive only $1 in earned credits since, after passing the $100 threshold for play on the gaming machine, no additional earned credits are awarded for passing other thresholds.

The level 4 player would receive $13.00 in earned credit bonus for playing $400, calculated as base (level 1) award of 10 base credits from FIG. 3 (1+2+3+4) multiplied by the earned credit multiplier .times.1.3.

The level 5 player would receive $0.00 since the player had not yet achieved the $500 threshold at which earned credits are awarded. As play is tracked during earning play periods, the player could return at a later earning play period time and play $100 more to earn the $22.50 earned credit bonus award, calculated as base (level 1) award of 15 base credits from FIG. 3 (1+2+3+4+5) multiplied by the earned credit multiplier .times.1.5.

Once the "At player's level" earned credit bonus is awarded, the player has no incentive to play further and must redeem the earned credits before accumulating more.

EXAMPLE 3

Award at Player's Level and Up

With this type of ReturnPlay bonus selected, players have to play to their normal play level to earn an award but will continue to accumulate awards with additional play. Unlike the award scheme described in Example 2, therefore, additional play does earn any additional credit. The following bonus payout award table results from selecting the award "At player's level" option in the Scheduled ReturnPlay Main Settings screen (FIG. 3) and using the award level settings shown above and in FIG. 4.

| Amount Played | Level 1 Award | Level 2 Award | Level 3 Award | Level 4 Award | Level 5 Award | Level 6 Award | Level 7 Award |
|---|---|---|---|---|---|---|---|
| $100 | $1.00 | $0.00 | $0.00 | $0.00 | $0.00 | $0.00 | $0.00 |
| $200 | $3.00 | $3.30 | $0.00 | $0.00 | $0.00 | $0.00 | $0.00 |
| $300 | $6.00 | $6.60 | $7.20 | $0.00 | $0.00 | $0.00 | $0.00 |
| $400 | $10.00 | $11.00 | $12.00 | $13.00 | $0.00 | $0.00 | $0.00 |
| $500 | $15.00 | $16.50 | $18.00 | $19.50 | $22.50 | $0.00 | $0.00 |
| $600 | $21.00 | $23.10 | $25.20 | $27.30 | $31.50 | $36.75 | $0.00 |
| $700 | $28.00 | $30.80 | $33.60 | $36.40 | $42.00 | $49.00 | $56.00 |

As with Example 2, suppose that a level 1 player, a level 3 player, and a level 5 player each gamble $400. Earned credits accumulated within the MCI 50 of the EGM 12 for the level 1 player would result in a $10 award (versus only $1 award with "At Player Level" setting). This award would be transferred to the player server 40 as $10 in earned credits (stored as 1000 cents) upon removal of player card 66 from the card reader 60 at EGM 12 and stored within the player account. Earned credits are converted to playable redeemed credits by returning the casino at a later time during a redemption period according to the process described further below. The level 1 player would receive $10 in earned credits since, after passing the $100 threshold for play on the gaming machine, additional earned credits are awarded for passing other thresholds. Note that awards for level 1 players is identical as in Example 1.

The level 3 player would receive $12.00 in earned credit bonus for playing $400, calculated as base (level 1) award of 10 base credits from FIG. 3 (1+2+3+4) multiplied by the earned credit multiplier .times.1.2.

The level 5 player would receive $0.00 for only playing $400 since the player had not yet achieved the $500 threshold at which earned credits are awarded. As play is tracked during earning play periods within the same bonus pool, the player could return at a later earning play period time and play $100 more to earn the $22.50 earned credit bonus award, calculated as base (level 1) award of 15 base credits from FIG. 3 (1+2+3+4+5) multiplied by the earned credit multiplier .times.1.5.

Once the "At player's level" earned credit bonus is awarded, the player still has incentive to play further while preferred patrons are awarded more. By setting the earned credit multiplier for all levels to 1, all players would be awarded the same amount once they reached their normal level of play. That is, the level 1 and 3 players would each be awarded $10.00 in earned credits for playing $400. The level 5 player, not having reached the $500 "normal level of play," would receive $0.00.

An optional, yet important, part of the bonusing scheme of the present invention is the idea of Enticement. There are three entice choices listed in FIG. 3 labeled under as "Entice Messages" selections. The first selection is for "no enticement", meaning that no messages are displayed on the VFD 58 relating to the amount of play remaining until the next threshold is reached.

The second selection will cause the MCI 50 to track the cumulative amount bet by the player and issue a command to the VFD 58 to display an enticement message when the tracked cumulative amount bet approaches the next threshold to be reached by the player. A box within FIG. 3 allows a casino operator to configure the bonus to set the value below the next threshold at which the enticement message is displayed. For example, if the enticement is set at $20 before a level and the player has currently played $150, the message will display when player plays $180. If, as in Example 3 above, a level 5 player has played $150, the message will display when the player plays $480 because no ReturnPlay bonus will occur, and no earned credits awarded, until the level 5 player reaches $500.

Finally, the third selection causes the enticement message to be played multiple times between thresholds at even intervals. The number of intervals is determined by the number entered into the box provided in the configuration program screen shown in FIG. 3. For example, if the enticement message is set to occur three times between levels such as those of $100 multiples set in FIG. 4, the message would be displayed at $25, $50 and $75 after each threshold. If the enticement message is set to occur 1 time, then the MCI 50 would only trigger an enticement message at the VFD 58 at $50 after each threshold (e.g. at $50, $150, $250, etc.).

Figure 5:
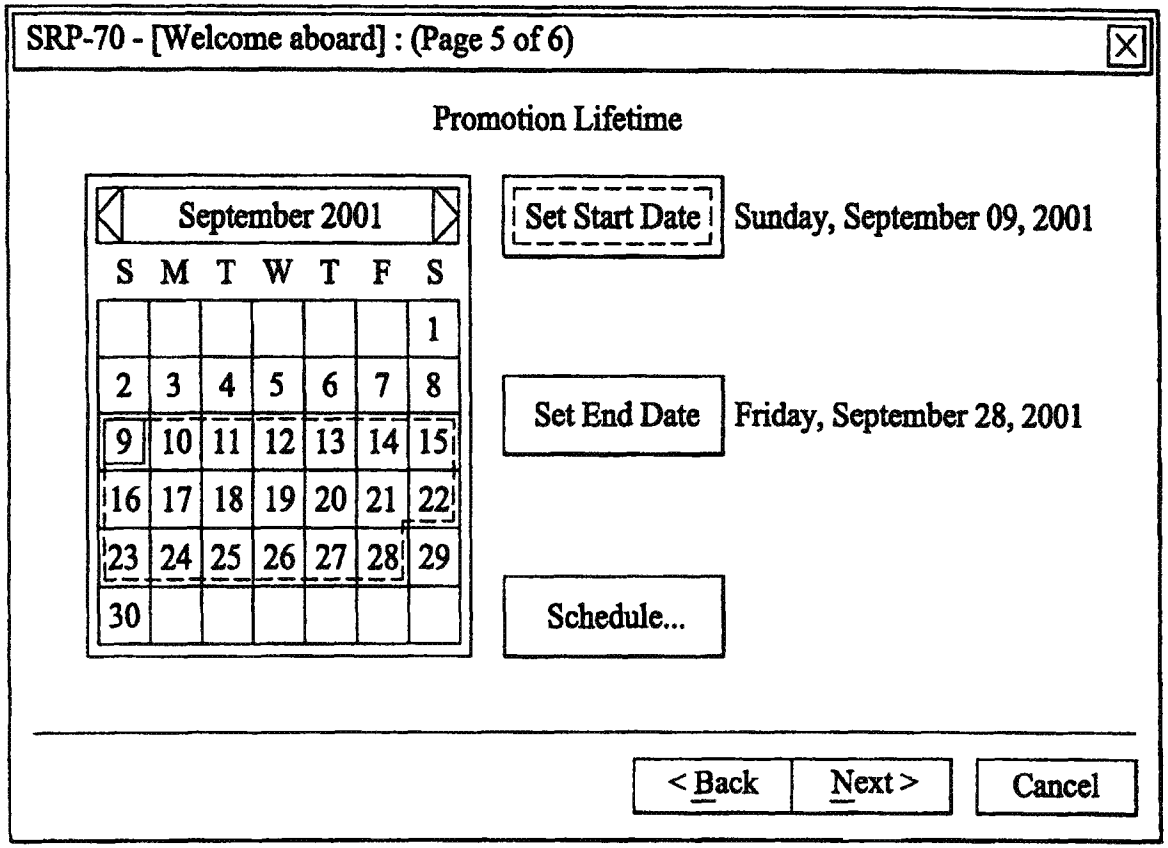

A major component of the Schedule ReturnPlay bonus operated according to a preferred embodiment of the invention is the ability to schedule when ReturnPlay credits are earned ("earned credits") and when they are redeemed ("redeemed credits"). FIG. 5 illustrates another screen of the configuration program used to designate criteria of the bonus, specifically the start and end dates for the promotion identified by the pool name listed in FIG. 3.

TABLE 5

Scheduled ReturnPlay Scheduling Fields [FIG. 5]

| Field Name | Description |
|---|---|
| Monthly Calendar Display | Fully functional presentational calendar. |
| Set Start Date | ReturnPlay promotion start date. |
| Set End Date | ReturnPlay promotion end date. |
| Schedule . . . | Opens daily schedule for earning and redeeming time periods |

To set the start date of the pool promotion (named "Welcome aboard" in FIG. 3), the operator positions the computer cursor of the configuration workstation 40 over the day of the month and depresses the mouse button. In FIG. 5, the box around Sep. 9, 2001 is highlighted once selected on the calendar. The operator sets this as the start date of the bonus pool promotion by selecting the "Set Start Date" button displayed on the configuration workstation monitor. The selected start date (Sunday, Sep. 9, 2001) then appears next to the button to indicate the promotion start date.

A similar procedure is used to select the end date of the pool promotion. The computer cursor is positioned over a selected day on the calendar and the mouse button depressed to select that day. The "Set End Date" button is then depressed to confirm the selection (Friday, Sep. 28, 2001).

Figure 6:
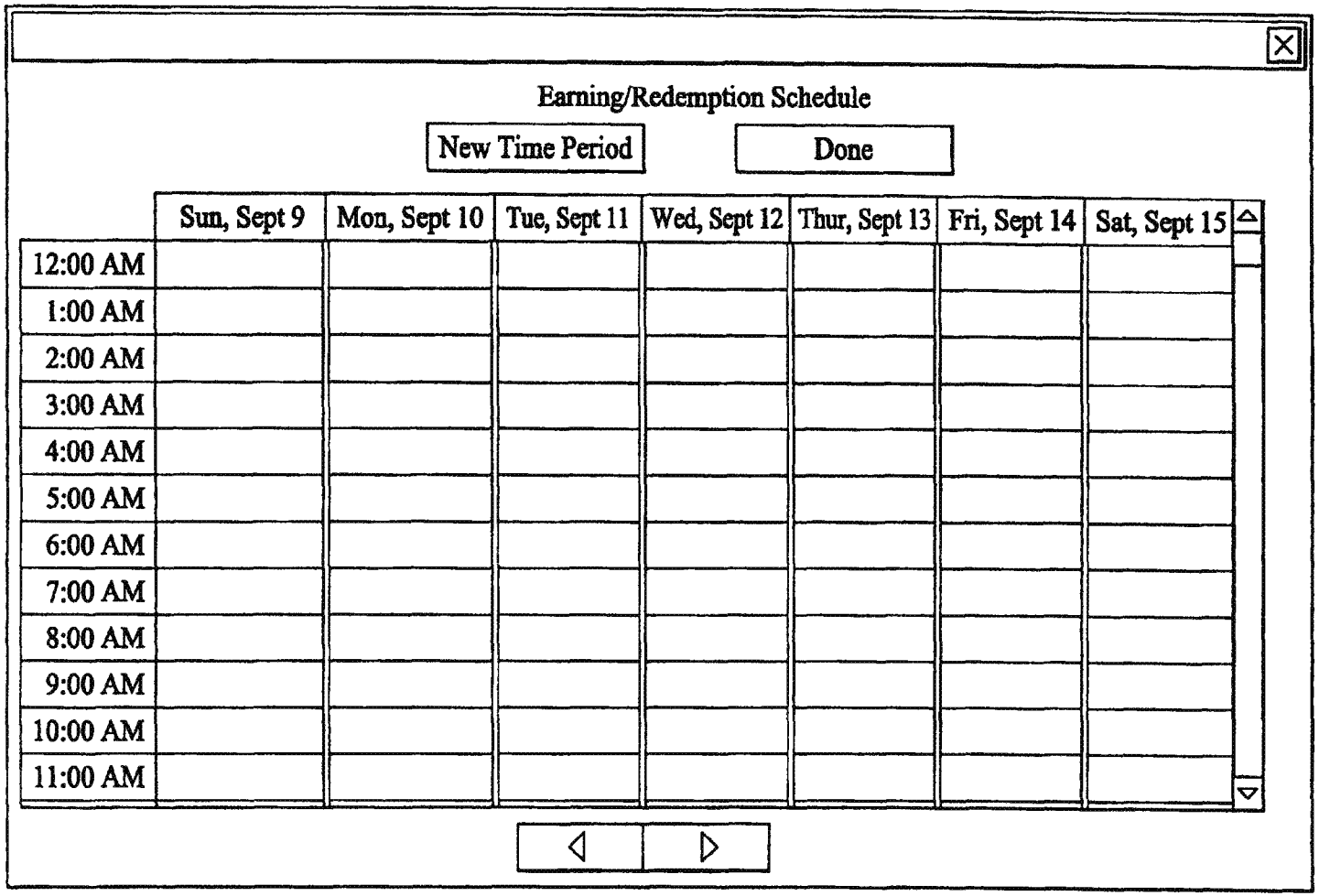
Figure 7:
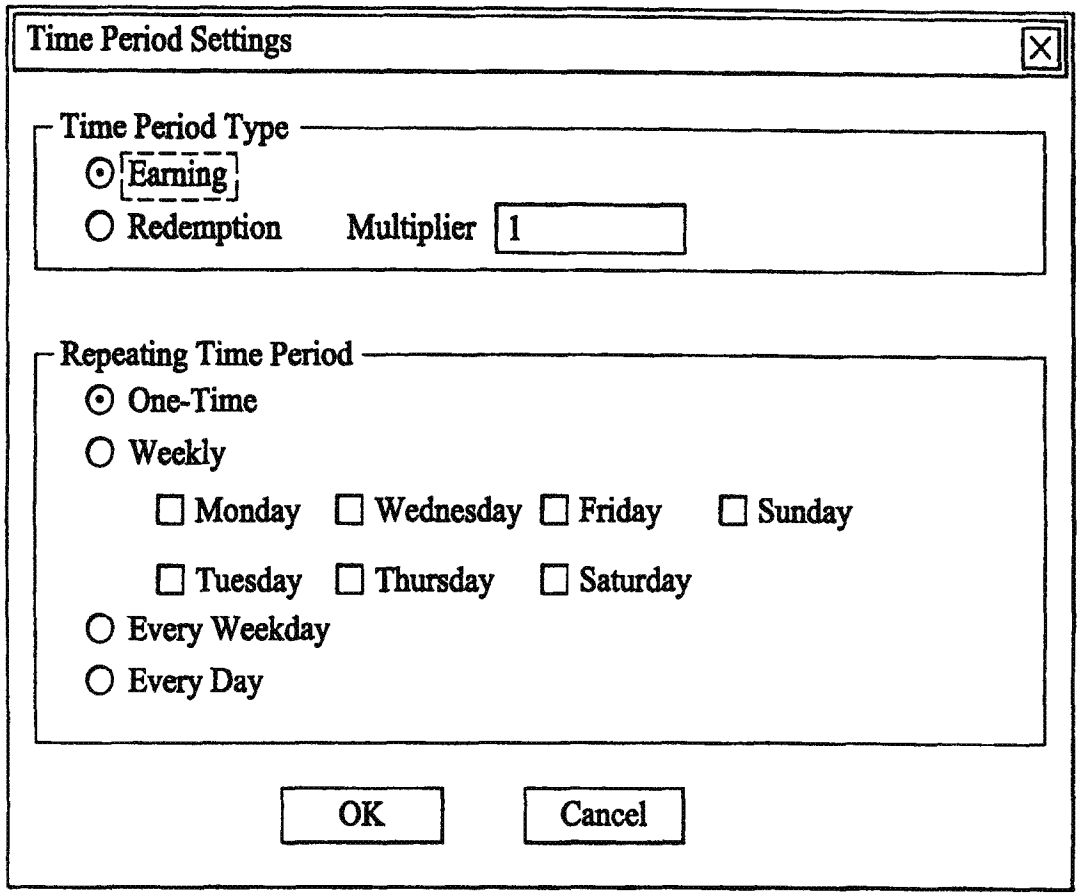

Once the start and end dates have been set, the operator clicks on the "Schedule" button to bring up the earning/redemption schedule shown in FIG. 6. The screen shown in FIG. 6 defines the time periods when ReturnPlay credit can be earned or redeemed. A time period is defined by selecting the times on the schedule and pressing "New Time Period". This brings up a dialog to define the type of time period and any repeated occurrences as shown in FIG. 7. ReturnPlay credit can only be earned during an earning period, or redeemed during a redemption period. Redemption periods can increase the base award by a redemption multiplier value, as an incentive to players who return at off-peak hours.

TABLE 6

Scheduled ReturnPlay Scheduling Fields [FIG. 7]

| Field Name | Description |
|---|---|
| | Time Period Type |
| Earning | Time period type within ReturnPlay. |
| Redemption | Time period type within ReturnPlay. |
| Multiplier | For redemption purposes, the base reward redemption multiplier incentive, if any. |
| | Repeating Time Period |
| One-Time | One time bonus earning/redemption time period configuration. |
| Weekly | Period within the applicable week during the promotion for earning/redemptions. |
| Every Weekday | Period during the promotion for weekday earnings/redemptions only. |
| Everyday | Period during the promotion for all applicable days within the earning/redemption period. |

Figure 8:
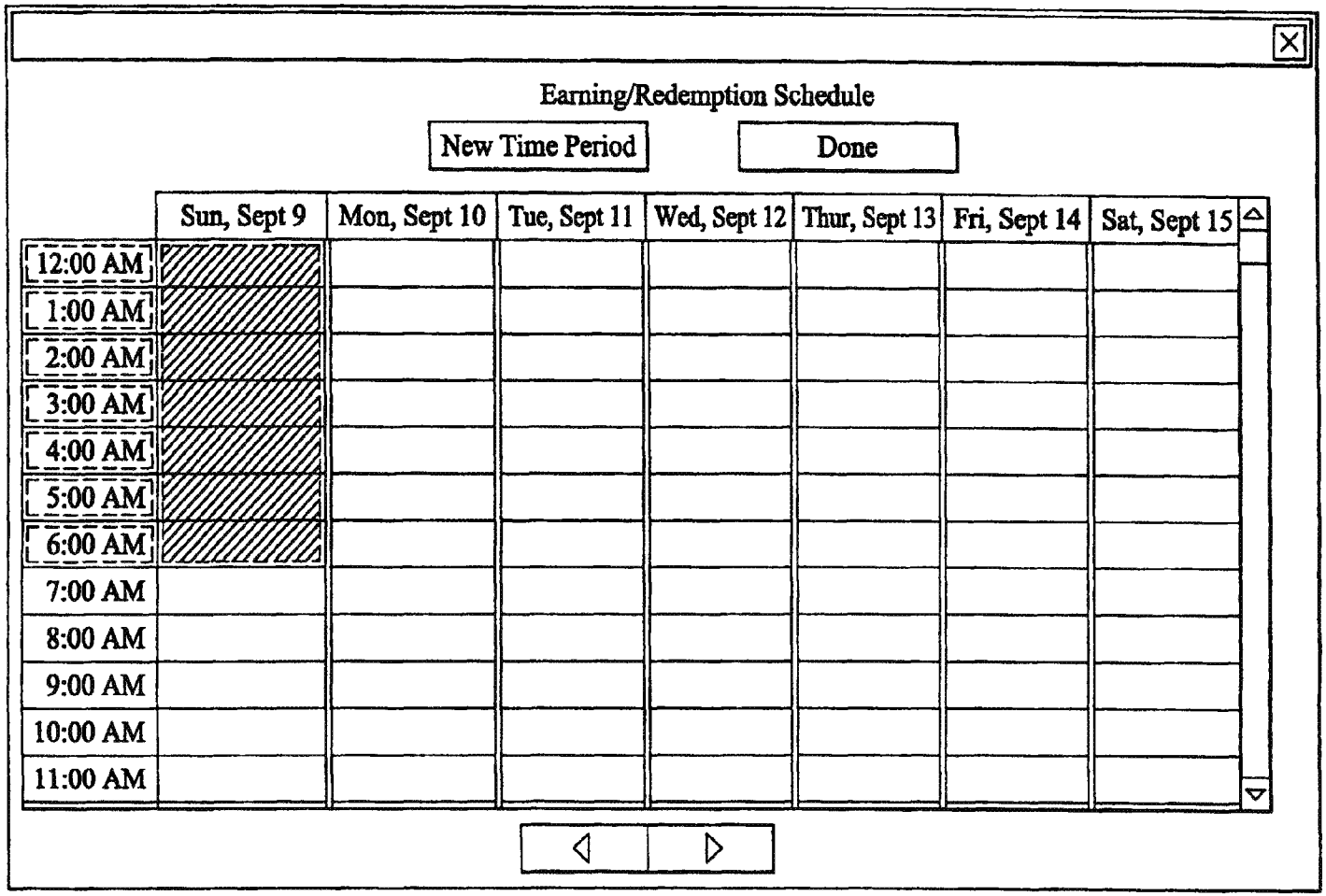
Figure 9:
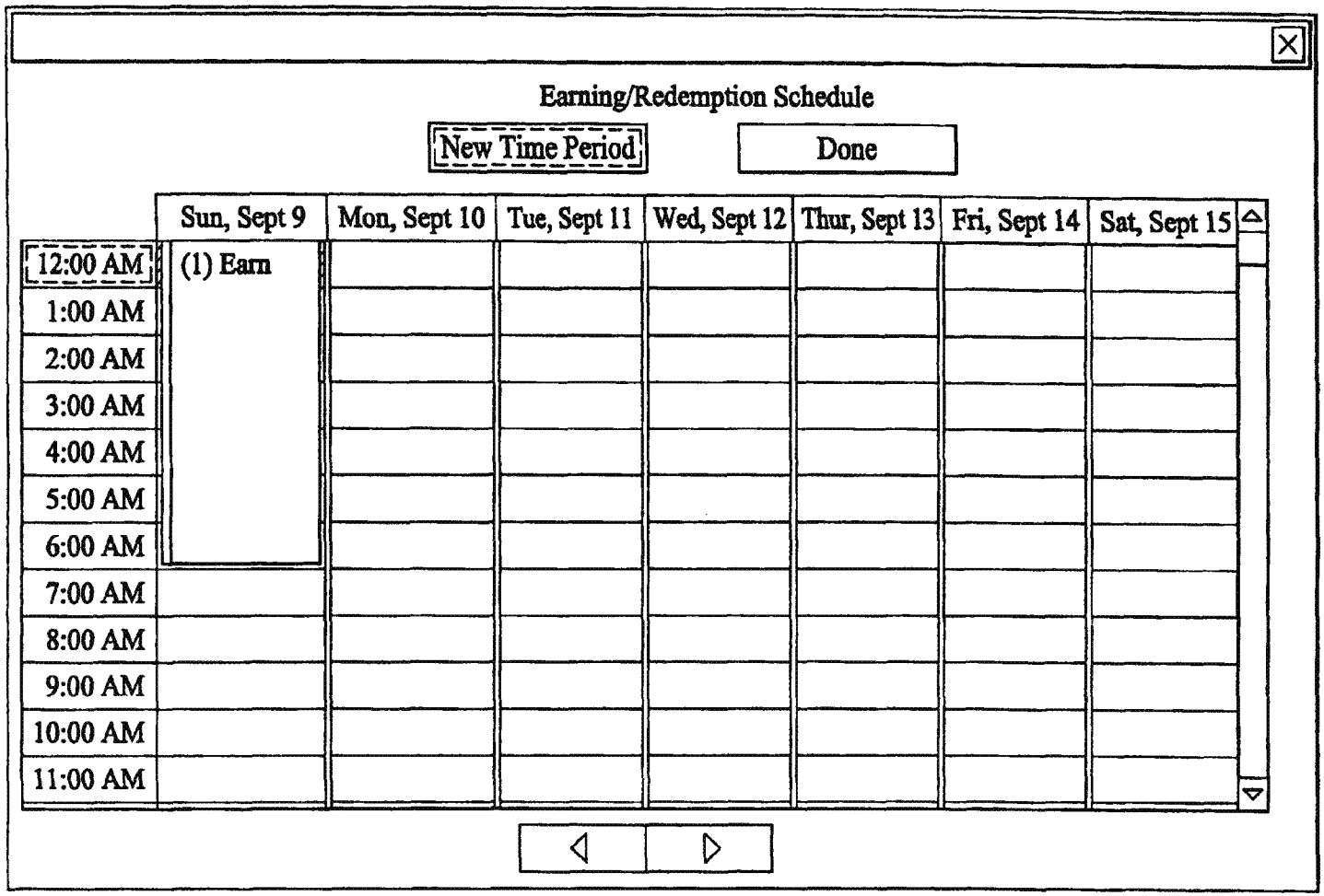

To create a Scheduled ReturnPlay time period, a range of time values is selected. For example, the screen shot shown in FIG. 8 has the time from 12:00 midnight to 7:00 AM selected. Next, the user selects "New Time Period" button to bring up the time period dialog shown in FIG. 7. The values are entered and the user selects the "Done" button to create the time period. FIG. 9 shows a One-time earning period from 12:00 midnight to 7:00 AM on Sunday Sep. 9, 2001 creating using the criteria selected in FIG. 7—that is, it is an earning period for time period selected in FIG. 8 that does not repeat throughout the week. The defined time period now shows up as an "(1) Earn" period in the graphic user interface screen to tell the operator of the configuration workstation that the period is the first one defined. Additional time periods can be defined, as long as two rules are followed:

1) The first time period defined in a promotion must be an earning period

2) The last time period defined in a promotion must be a redemption period

The reason for these rules stems from the operation of the promotion according to a preferred embodiment of the invention. Each promotion pool set up in FIGS. 3 and 4 and scheduled by FIGS. 6-8 is intended to start on a certain date and end on a certain date. Credits earned during the earning periods set up on the calendar feature (FIGS. 6-8) can only be used during redemption periods of that pool. Beyond the end date of the pool, all credits (whether earned or redeemed) are set back to zero in the player account stored on the player server 42 whether they are used or not. Accordingly, credits must be earned before they are redeemed; and credits must be redeemed before they are used.

Figure 10:
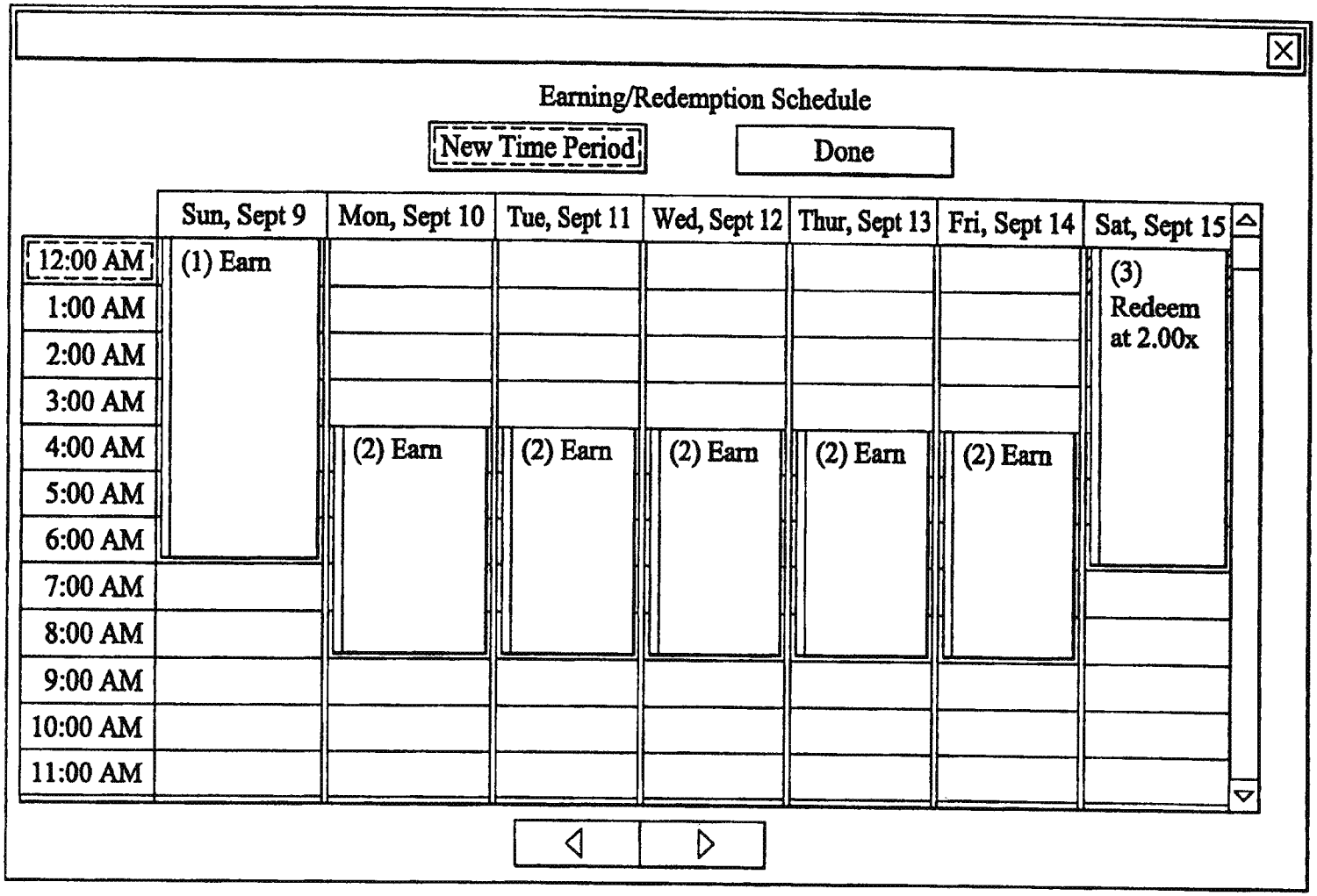

FIG. 10 shows a fully defined pool calendar having certain earn times and a redeem time. The screen shot shown in FIG. 10 does not show the full extent of the period defined on the calendar screen (FIG. 6) but it is understood that the remaining days and time periods can be shown by using the scroll down bar or using the backward-forward buttons at the bottom of the screen. Each day is shown in column format with times during the day shown by rows. The pool promotion defined includes a one-time earning period ("(1) Earn") from 12 to 7 AM, a weekday earning period ("(2) Earn") from 4 to 8 AM that operates during all weekdays during the promotion period, and a one-time redemption period ("(3) Redeem at 2.00.times.") with a 2.times. multiplier. The numbers on each schedule entry show which entries are grouped together—that is, an operator would be able to tell immediately that all 4 to 8 AM earn periods defined belong to one selection group.

Using the settings of FIG. 10 as an example, a player will continue to accumulate earned credits from Saturday through Friday (at the specified times) and then redeem those credits on Saturday at a 2.times. multiple. If a level 3 player, operating under a "pay at player level and above" selection, were to play $150 on Sunday between 1 and 3 AM, another $250 on Tuesday from 10 to 11 AM, and $300 on Friday from 5 to 6 AM, then the player would have accumulated a total of $450 of play during the earning time periods. The $250 played on Tuesday was outside of the earning time period and therefore would not count toward the total. From the table shown in FIG. 4 and used in Example 3 above, the level 3 player would be awarded $12.00 in earned credits and the amount stored in the player account. Note that the total play is accumulated until the player inserts his or her card into the card reader of the EGM during a redeem time.

If the player plays again on Saturday morning at 5 AM, then the card reader 60 sends the ID number read from the card to the player server 42 which then downloads the player account information (including the earned credits) into the MCI 50. The bonus server operating the pool promotion transmits through the gaming network every few seconds a data stream that is received at each MCI 50 on the network. The data stream includes configuration data regarding the promotion, including data bits identifying whether an earn period is active or a redemption period is active. The bonus server operates by comparing a clock signal to the calendar data configured within the configuration workstation 40 and stored at one or more bonus servers 42, 44. If the clock signal is within an earn period, then a data bit is broadcast during the data stream to activate the earn period flag in the MCI. Likewise, if the clock signal is within a redemption period, then a data bit is broadcast during the data stream to activate the redeem period flag. An MCI 50 receiving the player account information, noting that a redemption period is active, acts to convert the earned credits to redeemed credits by applying the redeem credit multiplier (e.g. 2.times.) broadcast with the data stream. The earned credits are then irrevocable converted to redeemed credits that can then be played on the gaming machine. The player with $12.00 in earned credits would have instead $24.00 of redeemed credits to play with. The earned credits meter is zeroed out and the player can then begin earning more earned credits in subsequent earning periods.

Upon removal of the player's card 66 during play will cause the number of unplayed redeemed credits to be transmitted back to the player server 42 and stored within the player account for later use.

Figure 11:
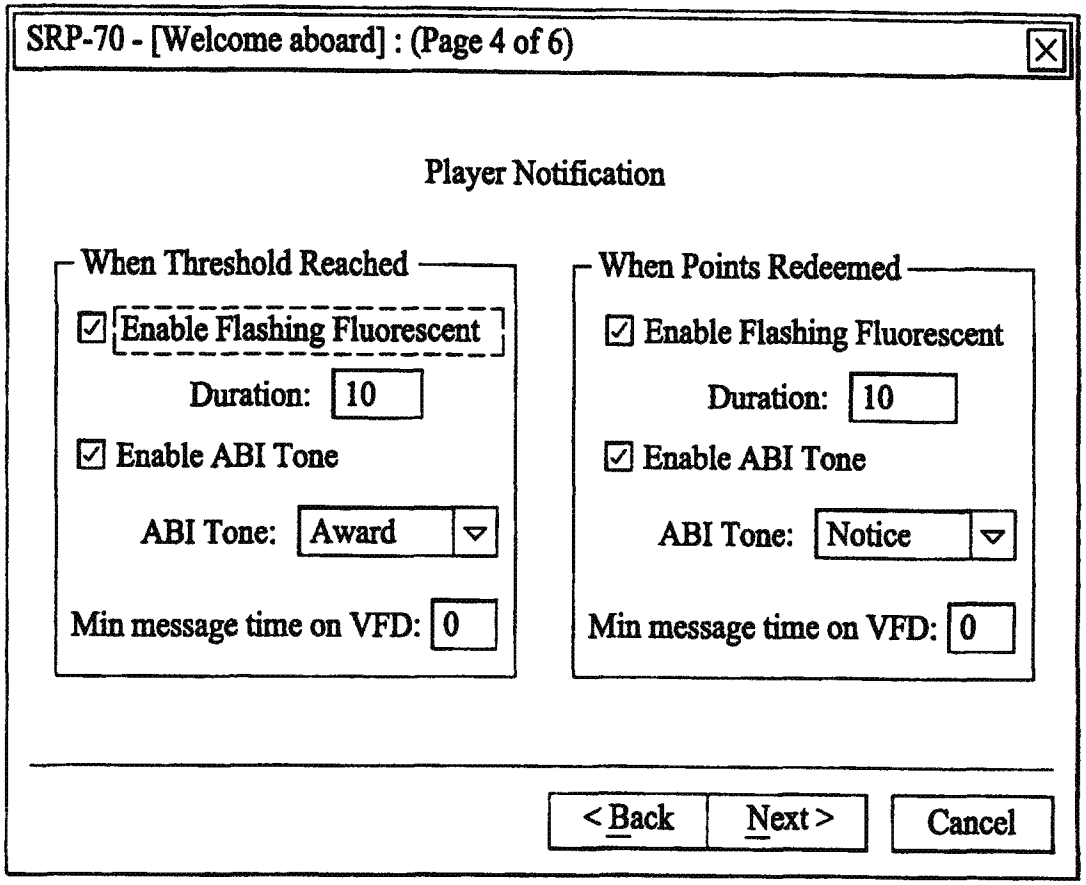

The screen shown in FIG. 11 defines what notification is given to the patron when an award is earned or redeemed. Table 7, below, defines each of the criteria shown in FIG. 11.

TABLE 7

| Player Notification Settings Fields [FIG. 11] | |
|---|---|
| Field Name | Description |
| When Threshold Reached | |
| Enable Flashing Fluorescent/ Duration | Enable/Disable flashing fluorescent display and duration in seconds. |
| Enable ABI Tone/Type Tone | Enable/Disable ABI Tone and select type tone. |
| Minimum Message Time on VFD | Minimum VFD second time. |
| When Points Redeemed | |
| Enable Flashing Fluorescent/ Duration | Enable/Disable flashing fluorescent display and duration in seconds. |
| Enable ABI Tone/Type Tone | Enable/Disable ABI Tone and select type tone. |
| Minimum Message Time on VFD | Minimum VFD second time. |

Figure 12:
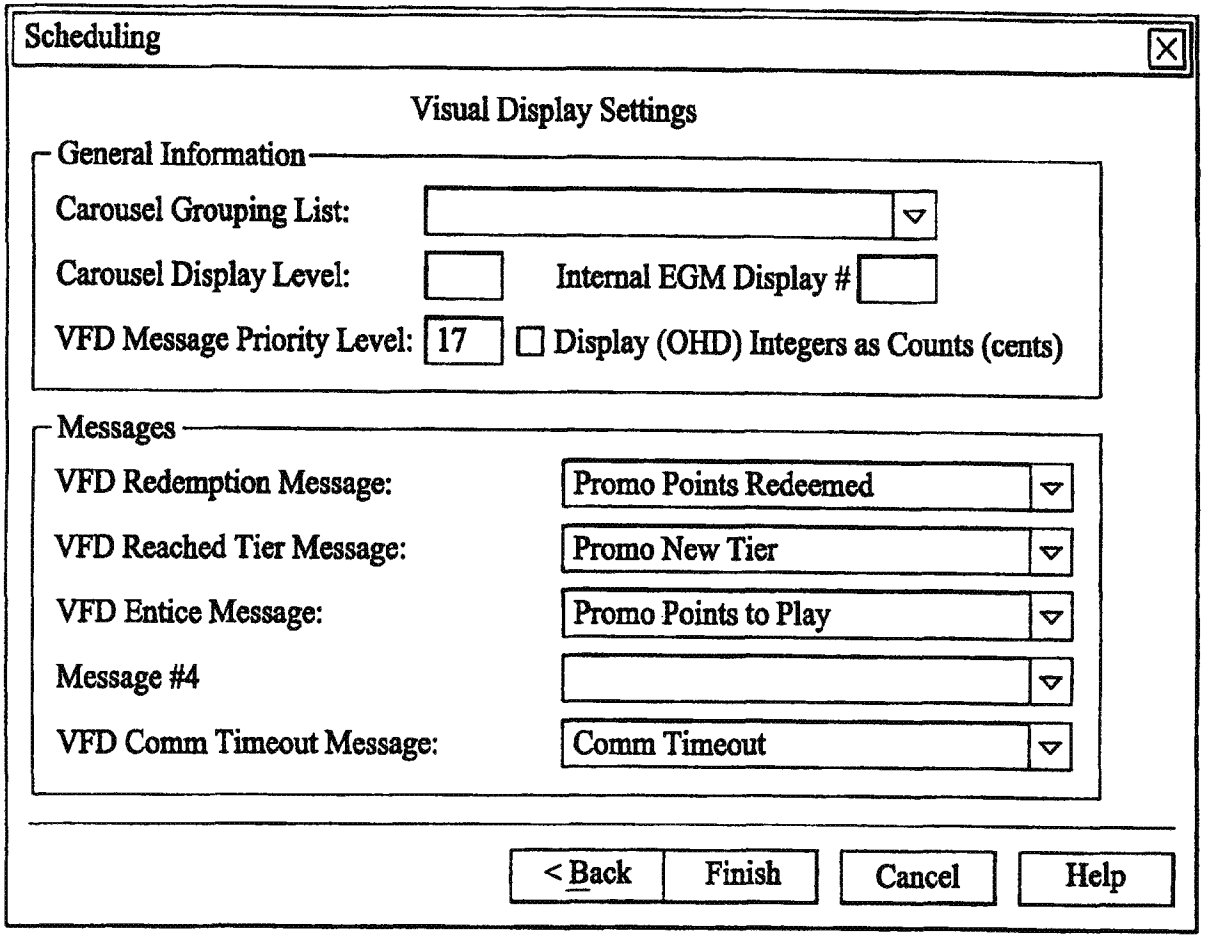

FIG. 12 illustrates the message screen configuration set by the operator. In the bonus promotion described according to the preferred embodiment of the invention described above, there are three bonus messages defined: greet a player redeeming earned credits, notify points earned and next tier attained, and enticement message noting the player level to the next tier. Confirm how the switches will be set in FIG. 12 and ensure messages match settings.

TABLE 8

| Visual Display Settings Fields [FIG. 12] | |
|---|---|
| Field Name | Description |
| General Information | |
| Carousel Grouping List | N/A |
| Carousel Display Level | N/A |
| Internal EGM # Display | N/A |
| VFD Message Priority Message | Selected priority level for controlling the order of simultaneous messages. |
| Display [OHD] Integers as Counts [cents] | N/A |
| Messages | |
| VFD Redemption Level | Message display for redemption credit availability. For example, the redemption message could contain the message such as "reward of [total reward so far] with current multiplier of [redemption multiplier] gives you [Bonus Amount]" or "Reward of $10.00 with current multiplier of 2 gives you $20.00 reward!" |
| VFD Reached Tier Message | Congratulatory message for next tier obtained. For example, "VFD Reached Tier Message" At each tier reached if enticed at each threshold and at their tier. The winning message would be something like "Congratulations, you have earned a Return Award of [total reward so far] or" "Congratulations, you have earned a Return Award of $4.00" |
| VFD Entice Message | Inform message confirming player status to next level. Depending upon configuration, a percentage incrementally notified before the reached level. For example, the Entice message could display at X % between tiers or an absolute value such as "Play [$ to next tier] more to reach next tier". |
| VFD Comm Timeout Message | Optional message if the bonus server is offline. |

Use of the redeemed credits as played credits preferably operates by one of two methods: where the redeemed credits allow a player to play a free game, and where the redeemed credits allow a player to play a half price game. Both methods are described below.

In a free game method, redeemed credits are automatically debited from the redeemed credit account stored within the MCI 50 during the redemption period. For instance, a $24.00 redeemed credit balance will allow one to play a $1 machine with a max $3 bet 8 times at max bet or 24 times at minimum bet. Once exhausted, the player's regular credits are used to play the gaming machine. Redeemed must be used during the promotion period or lost; they cannot be cashed out. In this way, players are given incentive to visit the casino during times when the redemption periods are active to use these bonus credits toward game plays without using their own real credits. The casino can then drive players to the casino floor during off-peak hours by setting the redemption times during those hours. In particular, casinos can award increased redemption multipliers during the lowest off-peak times to further encourage play during those times.

In a half-price wager, each time a wager is placed by the player on the gaming device, half of the wager value is subtracted from the displayed amount and added to an internal EGM credit meter. For example, suppose a ten credit wager is placed with $4.00 showing on the account display 70 of a nickel slot machine with a 50 credit balance. The ten credits are removed from the internal EGM credit meter 70 and five credits of value equaling $0.25 are deducted from the number of redeemed credits. The five credits are simultaneously added to the credit meter 70. Thereafter, the coin-in display 72 shows a player bet of $0.50, the credit meter 70 shows an account balance of $3.75 and the VFD 58 shows a redeemed credit balance of 45. The player has just gotten a 10 credit wager while spending only five credits.

Embodiments of the present invention further provide for the implementation of weighted pay tables for bonusing. When a player qualifies to receive a bonus award, and the appropriate weighted pay table is selected, the bonus award amount is randomly determined from the weighted pay table. The bonus award can have a designated expected value, which the gaming establishment sets by configuring the weighted pay tables accordingly. The weighted pay table configurations disclosed herein are applicable to a wide variety of bonus server and system network configurations, and can be implemented on one or more servers or data processing apparatus in a gaming network.

Figure 13:
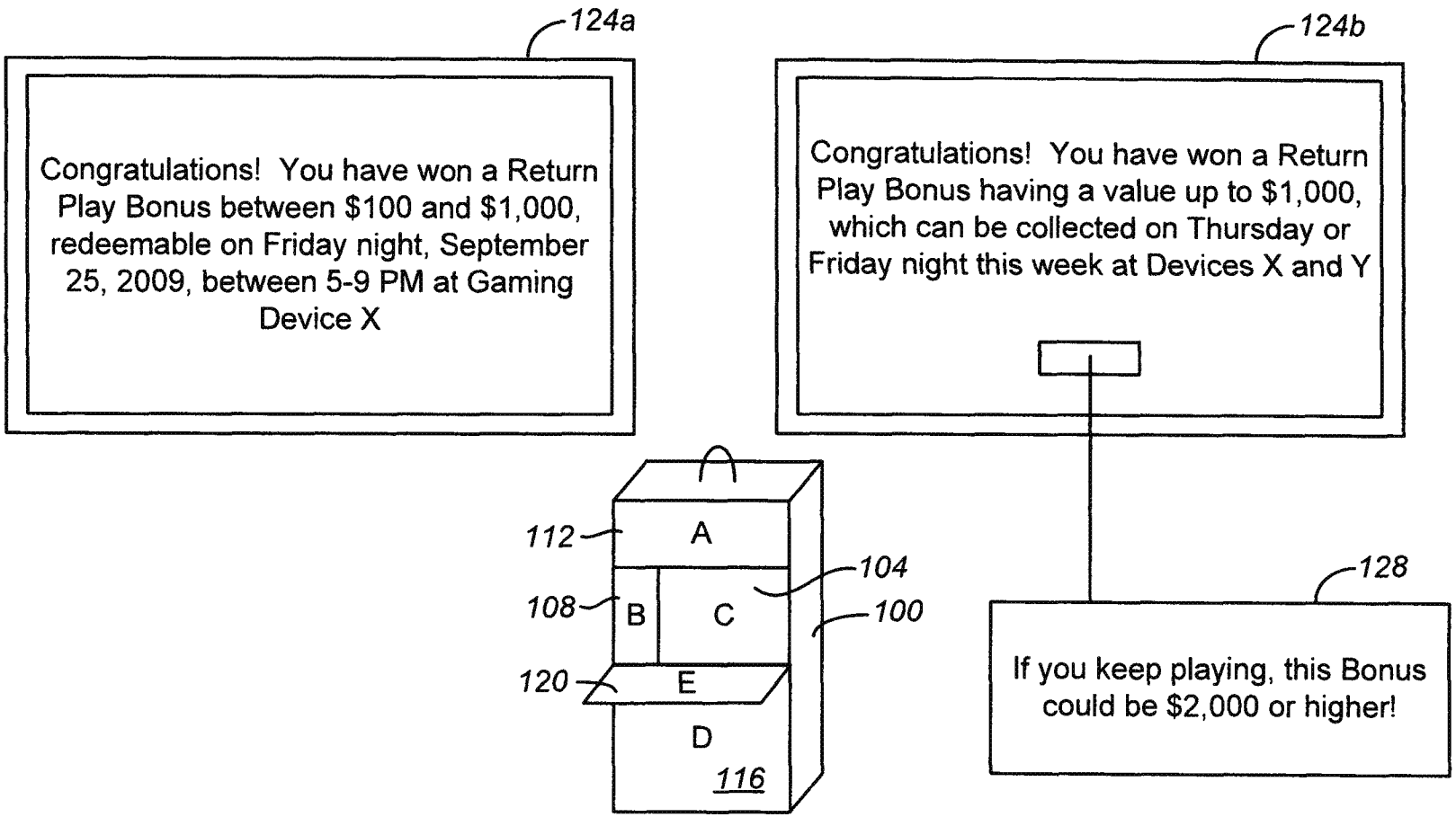
FIG. 13 shows a gaming device in the form of a gaming machine 100 having several displays mounted at various locations on the gaming machine, in accordance with one embodiment of the present invention.

FIG. 13 shows a gaming device in the form of a gaming machine 100 having several displays mounted at various locations on the cabinet of the gaming machine 100. These displays include main display 104, information panel 108, top box display 112 situated in a top box region of the gaming machine 100, a belly display 116 situated in a belly region of the gaming machine 100, and one or more button panel displays 120 situated on a button panel of gaming machine 100. The locations of displays 104-120 on gaming machine 100 represent one possible construction of gaming machine 100. The various displays including secondary displays 108-120 can be situated at different locations on gaming machine 100, for instance, on side panels of the machine.

FIG. 13 shows exemplary presentations of notifications regarding bonus awards that can be presented to a player at gaming machine 100 and to other players and bystanders in proximity to gaming machine 100. These exemplary presentations include presentation 124*a* and presentation 124*b*. These presentations can be displayed on any one or more of the various displays 104-120 on gaming device 100. For instance, in some bonus implementations, it may be desirable to display presentation 124*a* or 124*b* on a player tracking display, which gaming machine 100 may have been retrofitted to include. The display of such presentations 124*a* and 124*b* can be provided responsive to a player qualifying for a bonus award, in some implementations. In other implementations the presentation is displayed at some later time, for instance, responsive to the player inserting a bonus award coupon or voucher into a machine to redeem the bonus award.

In FIG. 13, both examples of bonus award presentations 124*a* and 124*b* include bonus award notifications that do not disclose the actual bonus award amount. This undisclosed amount or value is intended to fuel the player's excitement and intrigue as to the actual bonus amount, thus enticing the player to return to a casino or other suitable gaming environment in which gaming machine 100 is located, to redeem the unknown bonus award amount. In particular, the bonus award notification message of presentation 124*a* indicates a range of a value of the bonus award. For instance, presentation 124*a* displays, "Congratulations! You have won a ReturnPlay bonus between $100 and $1,000, redeemable on Friday night, Sep. 25, 2009, between 5:00 p.m. and 9:00 p.m. at gaming device X." Thus, presentation 124*a* not only indicates the range of value between $100 and $1,000, but also specifies the ReturnPlay parameters of an indicated day, time, and location for redemption of the bonus award. Other indications of ranges of value can be non-cash in nature, for instance, indicating seat tickets in a range of less desirable to more desirable locations, as further described herein.

In FIG. 13, presentation 124*b* provides another example of a bonus award notification message that can be displayed to a player on any of the various displays on gaming machine 100. In presentation 124*b*, a message indicating a maximum value of the bonus award is provided, in particular: "Congratulations! You have won a ReturnPlay bonus valued up to $1,000, which can be collected on Thursday or Friday night this week at devices X and Y." In addition, in a scheduled ReturnPlay implementation, the presentation 124*b* can include suitable additional messages, such as message 128, notifying the player that the maximum value of the bonus award to be collected could be even larger if the player continues playing in the current session, and hits a higher threshold of play level.

FIG. 13 shows one scheme for enhancing the value of any of various types of bonuses, implementing embodiments of the invention disclosed herein. Various range amounts as shown in presentation 124*a* or maximum award amounts, as shown in presentation 124*b*, can be displayed to the player by retrieving such amounts from one or more of the weighted pay tables selected according to techniques described herein. In particular, the maximum award amount can be selected from the corresponding cell of such a weighted pay table, and the lower or minimum award amount can be selected in similar fashion. The displayed values can be cash in nature, such as dollar amounts or credit amounts, or non-cash nature. The possible award amounts can be predetermined according to knowledge of the amount of awards that are likely to generate increased interest among players.

Figure 14:
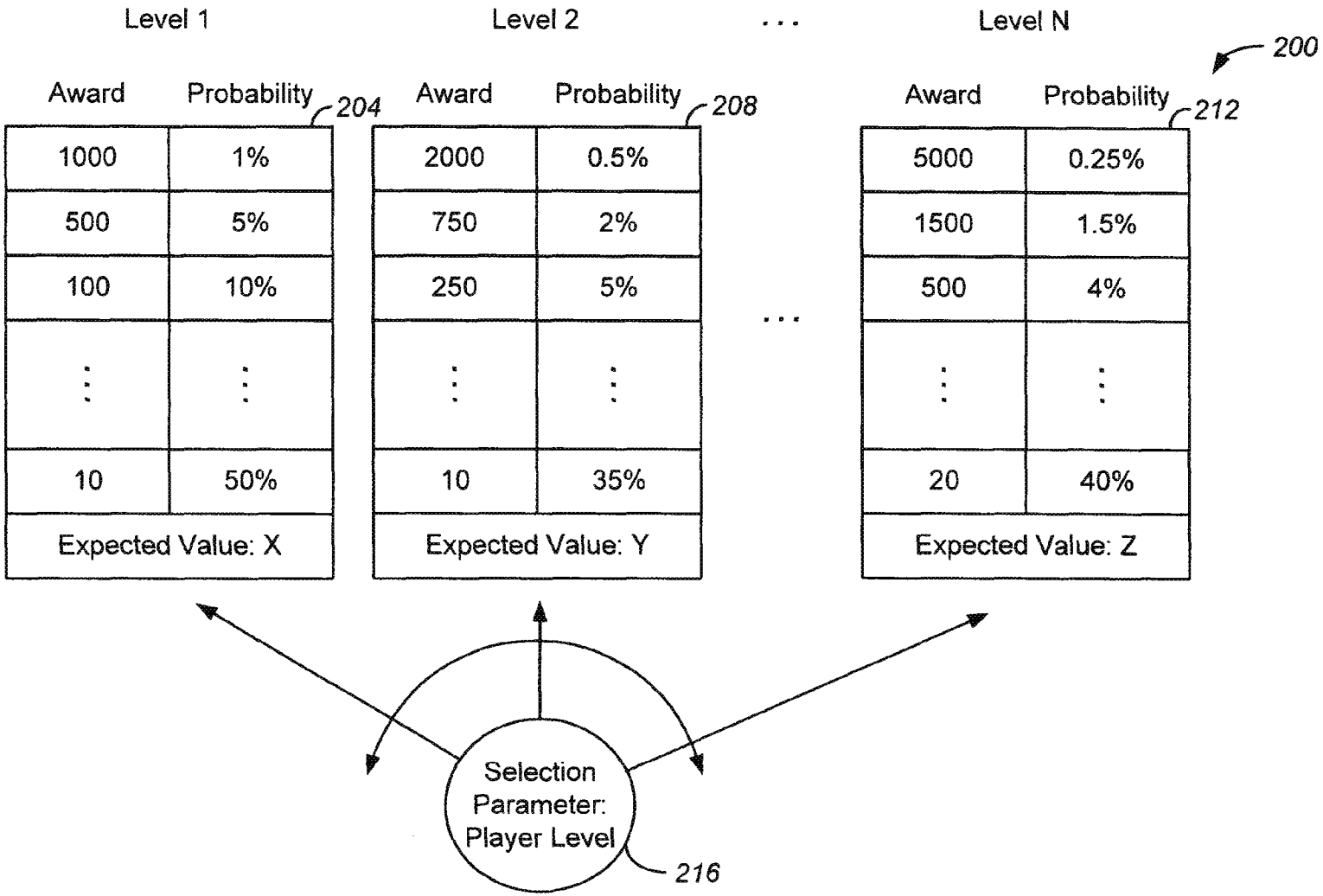
FIG. 14 shows a set of weighted pay tables 200 constructed according to one embodiment of the present invention.

FIG. 14 shows a set of weighted pay tables 200 constructed according to one embodiment of the present invention. Weighted pay tables 200 include a total of N pay tables comprising the set. For purposes of illustration, only three of the N pay tables are shown. These include pay tables 204, 208, and 212. These pay tables 204-212 can be stored in a suitable storage medium accessible on the gaming network, for instance, the hard drive situated at a host device configured to perform one or more of the operations described herein. Such a storage medium could include a hard drive, a CD-ROM, a flash memory device, and other storage media. In one implementation, the storage medium on which weighted pay tables 204-212 are stored is at a remote location on the network with respect to the host device. For instance, weighted pay tables 204-212 could be stored at a storage medium located at a gaming machine (EGM), as illustrated in FIG. 1.

In FIG. 14, each pay table includes a set of awards and associated probabilities, so that each award has a respective probability associated with it. In this way, the pay table is weighted so that certain award amounts have a higher likelihood of occurring than others. For instance, in weighted pay table 204, a set of awards are illustrated in the left hand column, in this implementation, beginning with a maximum award of $1,000 or 1,000 credits. Other award amounts, in this implementation, decreasing in value from $1,000, for instance, $500, and then $100, are located in subsequent rows of pay table 204. In this implementation, the maximum award amount of $1,000 has the lowest probability of 1% associated with it. Each award amount in the left-hand column of pay table 204 has a respective probability situated in the corresponding cell of the right-hand column, as shown.

A casino operator can structure the weighted pay table as desired. Examples of other pay table configurations are set forth in weighted pay tables 208 and 212, with different award amounts having respective probabilities, as illustrated in FIG. 14. For instance, in weighted pay table 212, the maximum award is $5,000, while the minimum award is $20. In this example, the lowest award amount of $20 has a much higher probability, 40%, than the maximum award of $5,000. Thus, the top award probability is very low, and the lowest award probability is much higher, in this example.

Each weighted pay table 204-212 can be configured according to a desired expected value for that pay table. For instance, weighted pay table 204 has an expected value of X, while weighted pay tables 208 and 212 have expected values of Y and Z, respectively. In one embodiment, a suitable user interface, for example, similar in format to the user interface of FIG. 4, can be provided to a casino operator to set up or adjust weighted pay tables 204-212 at various times. In one implementation, the expected value summary for each weighted pay table is provided in a separate field in the user interface, as shown in FIG. 14, while the individual cells of award amounts and respective probabilities are also displayed. In this way, an operator can set and adjust individual award amounts and probabilities, and the expected value of the total award amounts and probabilities is automatically computed and displayed. Thus, for example, a casino operator could choose to set the expected values X, Y, and Z of weighted pay tables 204-212 so that they are all equal, even though the respective sets of award amounts and probabilities of the individual weighted pay tables are different, as shown in FIG. 14. In this way, with the expected value summary provided to a casino operator as he adjusts award values and probabilities, the casino operator operating on behalf of a casino or other suitable gaming establishment can monitor the total exposure of the promotion or bonus to the casino.

In another implementation, through a suitable user interface, a casino operator can set a predetermined expected value amount, and one or more award amounts and/or probabilities are adjusted accordingly to achieve the desired expected value. For instance, in weighted pay table 208, when the expected value of Y is set, the user could choose to require that the awards in the left-hand column remain fixed, while a software module operable at the host device automatically adjusts one or more of the corresponding probabilities to achieve the desired Y expected value. Further variations are contemplated, in which one or more of the probabilities are set as fixed values, while the software module is enabled to adjust the other award probabilities to satisfy the desired expected value.

Thus, in the example of FIG. 14, when a casino indicates that it wants to run a promotion and give away an average of $20 to all players or a designated group of players, the one or more weighted pay tables 204-212 are configured so that the sets of award amounts are weighted with corresponding probabilities so that the expected value of the set of awards in a given pay table is $20. The casino can control its payout liability, and can also add fuel to the player's excitement and suspense by only announcing the top award amount. For instance, using pay table 212, the casino could simply announce, "Win up to $1,000 for ReturnPlay!"

The methods and apparatus for awarding bonuses using weighted pay tables, as disclosed herein, are generally implemented at one or more host devices, such as bonus server 44 and player server 42 of FIG. 1. In this way, when a bonus is triggered at one or more gaming devices, such as a gaming machine or gaming table having associated data processing apparatus with a network interface, messages can be sent to such host devices to carry out the selection of weighted pay tables and determination of appropriate bonus award amounts for the player. In one implementation, the selection of weighted pay tables leverages player preferences or player tracking information stored at player server 42, as further described herein. In the embodiment of FIG. 1, the weighted pay table data of FIG. 14 is stored at a storage device, such as a suitable database, accessible by one or more of the host devices 42-46. The operations and procedures described herein, for example, with respect to FIG. 17, can be implemented as executable blocks of code stored in one or more memory locations at a host device for retrieval and execution by a suitable processor in the host device. In an alternative implementation, one or more gaming devices serve as the host device, with the controller of the gaming device configured to perform the operations described herein, specifically with respect to FIG. 17. In this implementation, the weighted pay table data and other necessary data can be accessed remotely when stored at a different server or machine on the network, with suitable network access restrictions and permissions in place.

Returning to FIG. 14, the various weighted pay tables 204-212 can be structured to have a respective selection parameter associated with it. For instance, in FIG. 14, a selection parameter 216 retrieved during the bonus award procedures described herein is player level. Thus, each weighted pay table 204-212 has a respective level assigned to it. Weighted pay table 204 is provided for level 1 players, and weighted pay table 212 is provided for level N players. Thus, when the retrieved selection parameter 216 indicates a specific level, the weighted table associated with that level can be accessed and selected.

The player level data used as the selection parameter 216 in FIG. 14 can be measured over a designated period of time for each player and stored in a player account maintained at player server 42 of FIG. 1. Thus, player level data can be updated as the player places wagers at various times and at various machines in designated gaming environments, e.g., casinos.

In another embodiment, the player levels assigned to weighted pay tables 204-212 are replaced with another parameter such as player rank. In this embodiment, each weighted pay table 204-212 is assigned a respective player rank. These ranks can be specific to individual players, and measured according to the player's wagering behavior, measured over some period of time. The mechanism for selecting a weighted pay table and determining one of the awards of that selected table as the bonus award amount, as described herein, can be applied to ReturnPlay bonuses and other bonus award structures provided by the gaming establishment to benefit the marketing value and suspense associated with the bonuses.

In one example, in FIG. 14, there is a number of weighted pay tables, with corresponding ranks 1-N assigned to the pay tables. The ranks can be assigned using player loyalty status, such as gold, silver, bronze, or other rank indicators specified by a casino based on player history. Such loyalty information can be maintained and retrieved from player server 42 of FIG. 1, based on player history data maintained for a particular player or group of players. The award amounts provided in a weighted pay table of a particular rank can be structured accordingly. For instance, in FIG. 14, weighted pay table 204 is associated with the "silver" rank. The maximum award amount is $1,000. Weighted pay table 212 is associated with the "platinum" status or rank, and the maximum award in pay table 212 is $5,000. By having different pay tables associated with different player ranks or loyalty status, the gaming establishment can address a broader spectrum of players monitored in a casino database by player server 42 of FIG. 1.

As described above, the selection parameter 216 of FIG. 14 can be a parameter maintained in the gaming network for other purposes, such as the player level or player rank parameters described above. In this way, such data can be leveraged for the weighted pay table bonus selection, thus providing an additional beneficial use for such information. Such player ranking or player level information can be made known to the players, for instance, displayed when a player inserts his player tracking card, or can be transparent to the player. That is, the selection parameter such as player rank or level can be maintained at the back end by a gaming establishment for usage as described herein, without such information being accessible or otherwise made known to the player. In one embodiment, the player level or rank information is based on the player's historical contribution to the casino through game play, with the ranks tiered using a collection of such historical information for a total number or designated group of players.

Other various parameters associated with one or more players can be used as selection parameter 216 of FIG. 14, thus, in some embodiments, replacing rank or level as the variable for selecting pay tables. Suitable selection parameter 216 can include a time of play, a time of redemption, a date of play, a date of redemption, a time or date of other event, such as a player signing up for a player tracking program, an event occurring (e.g., the Miss Reno Pageant), and other events associated with or independent of player activity, including events associated with play and events associated with redemption. The selection parameter can also be group-specific, such as designated buses or tour groups, individuals known to be in town for an event such as a car show, family groups, family or tour groups with a designated minimum or maximum number of members, and individuals visiting a casino from less than or more than a certain designated radius or distance (e.g., people visiting the casino from more than 50 miles away).

When the selection parameter is a variable based on the date/time of redemption, this refers to when the player accesses a gaming device or other suitable bonus device to redeem an award. For instance, if the player visits the casino on Thursday night to redeem an award, in the example of FIG. 14, weighted pay table 204 is selected. But if the player were to return on Friday night, weighted pay table 212 is selected. Thus, certain days or nights of the week can be allocated greater possible award amounts, adding incentive for players to visit the casino at such specified dates and times when maximum award amounts or ranges of possible award amounts are announced.

Other various selection parameters can be used, often leveraging information already maintained at the back end of the gaming network for one or more players. Examples of such information include theoretical win, frequency of visit, average amount played per visit, a home address of the player, age, sex, designated group to which the player belongs, average bet amount, and type or types of games played. Often, such information is maintained for individual players as part of the player's player tracking or player profile information. Other types of player tracking information can be used as the selection parameter 216. In addition, player preference information, such as preferred themes, display presentations, denominations, graphical layouts, and other data maintained for particular players can be used as the selection parameter 216. In one example, each weighted pay table 204-212 is associated with a respective theme of a game or bonus award, and is selected according to the player's indicated or estimated preference for such theme, based on player tracking data maintained by player server 42.

FIG. 15 shows a weighted pay table 300 constructed according to another embodiment of the present invention. In this embodiment, the designated awards of a particular weighted pay table, as described above with respect to FIG. 14, are replaced with multipliers. These multiplier values are specified with reference to a base reward amount, for instance, 10 credits, in the example of FIG. 15. Similar to the weighted pay tables described above, each multiplier is situated in the left-hand column of weighted pay table 300, replacing the award amounts of the weighted pay tables of FIG. 14. Similarly, each multiplier field has an associated probability in the right-hand column of the weighted pay table 300. The embodiment of FIG. 15 is beneficial as an add-on to bonusing schemes in which a fixed bonus award amount, e.g., 10 credits, is automatically generated or provided as part of the bonusing scheme. In this way, using such a predetermined base award, the ultimate bonus award to be delivered to a player is computed by determining one of the multipliers in weighted pay table 300 according to the respective probabilities, and applying the determined multiplier to the base reward amount.

In FIG. 15, an expected value is displayed to an operator constructing the specific multiplier values of weighted pay table 300. The expected value can be monitored and adjusted, as described above. Here, the expected value is computed by applying the respective multipliers to the base reward amount, with the probabilities factored in as described above. In FIG. 15, different sets of multipliers, i.e., different weighted pay tables can be applied to the base reward amount, for example, on different days to entice the player to visit the casino on certain days.

FIG. 16 shows a weighted pay table 400, constructed according to another embodiment of the present invention. In the examples described above, cash-oriented award amounts are provided in each weighted pay table. In accordance with embodiments of the present invention, non-cash awards are also contemplated. For instance, in FIG. 16, the left-hand award column includes show tickets, as one example of a non-cash award. Thus, particular categories of tickets are listed in the left-hand column, with respective probabilities associated with each classification. A plurality of additional weighted pay tables can be provided, for instance, with show tickets for different types of concerts or performances. In this way, player preference or tracking information or other parameters as described herein can be used to select one of the weighted pay tables. In one example, a preference indicating that the player enjoys country music can be used to select a particular weighted pay table 400 with tickets to see a bluegrass concert. The bonus award is determined according to the probabilities set forth in the right-hand column, and a set of tickets to the bluegrass concert are then awarded to the player.

In FIG. 16, when the awards are non-cash in nature, a variety of types of bonus awards can be provided. Examples include expired inventory tickets to various shows or performances. The pay table 400 provides a mechanism for encoding the non-cash awards. The layout of the non-cash awards can be according to the estimated value of those awards, in some implementations. For instance, it can be estimated that certain seat tickets have a higher value than others, using the example of FIG. 16. The weighting of probabilities in the right-hand column can be set according to the estimated value or quality of the corresponding non-cash awards. Thus, in the example of FIG. 16, front row tickets are provided as the maximum value award at the top of the pay table 400, while balcony tickets are the minimum value award, located at the bottom of pay table 400.

Figure 17:
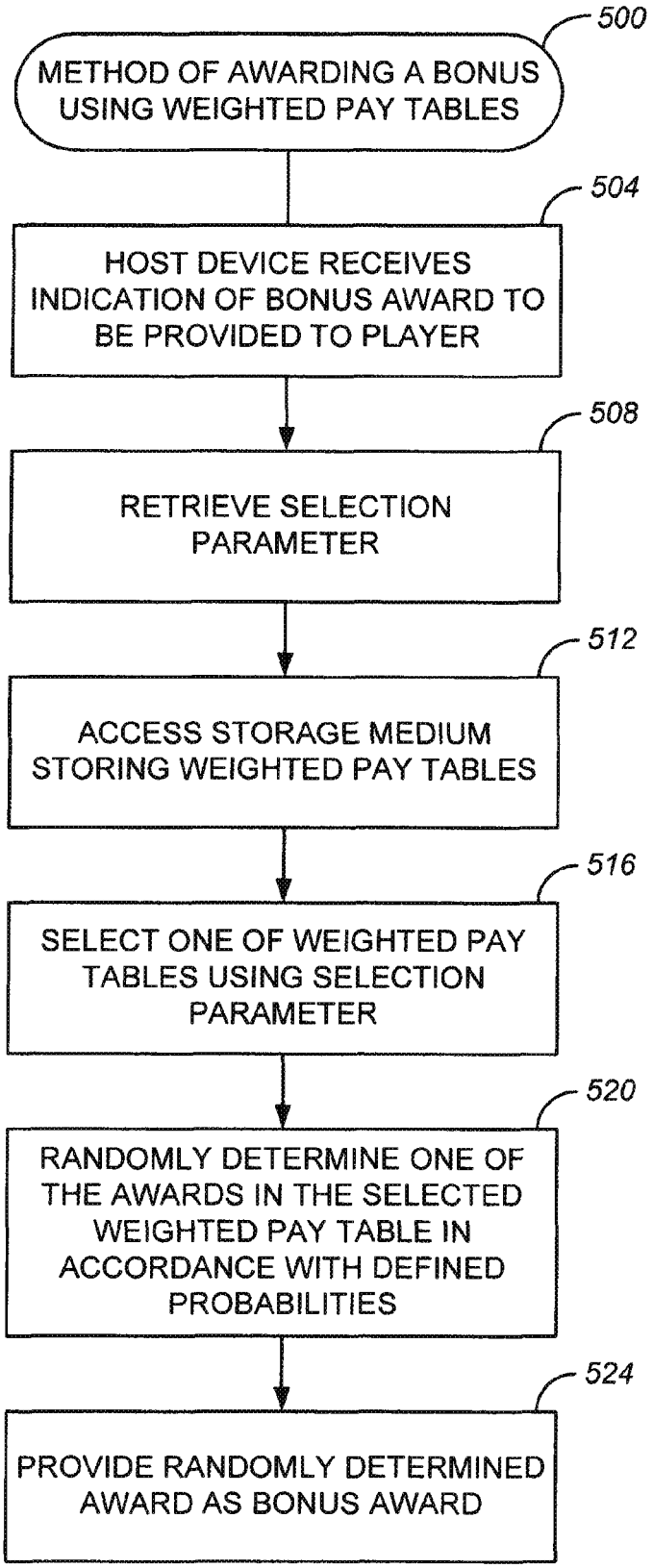
FIG. 17 shows a flow diagram of a method 500 for awarding a bonus using weighted pay tables, performed in accordance with one or more embodiments of the present invention.

FIG. 17 shows a flow diagram of a method 500 for awarding a bonus using weighted pay tables, performed in accordance with one or more embodiments of the present invention. The method 500 is described with reference to an embodiment in which the host device performs the selection of a weighted pay table and determination of a bonus award amount, where the host device is situated as a back-end server on the network. As mentioned herein, depending on the desired implementation, the method 500 can be performed by other devices in the network.

In FIG. 17, the method 500 begins in step 504 in which the host device receives an indication that a bonus award is to be delivered to a player. This indication, in step 504, can arise from various sources. For instance, a bonus can be triggered responsive to one or more events occurring as part of a game play session on the gaming device. In other instances, the bonus indication can be triggered independent of game play. There are various events or stages of a player's game play session, player activity, or casino-initiated activity that can cause the bonus indication to be triggered in step 504. As mentioned above, player tracking data indicating a player rank or player level may trigger the bonus award when such activity reaches or exceeds a designated level. The player can also qualify for bonuses by satisfying other various activity criteria, such as the initiation of game play on certain times, days, or during certain designated events.

In one embodiment, the bonus indication arises from the occurrence of a designated event. With most lucky coin events, for example, there is a range which a progressive jackpot will hit, that can be announced to or hidden from the players, depending on the desired implementation. When the player hits the lucky coin, in step 504, an indication of a grand jackpot to be awarded to the player is generated at the gaming machine or a server managing the lucky coin jackpot.

In step 504, the indication of the bonus award can relate to a promotion, often casino-initiated, to provide bonuses to one or more players. Such promotions can include, for example, consolation prizes awarded to one or more players participating in a bonus event or a progressive jackpot, as well as celebration prizes, which are generally awarded during play. For instance, consolation prizes are often bonus award amounts that are awarded to all participating non-winners of a lucky coin bonus. These and other various types of bonus awards, that is, independent of game play winnings, can provide a context for the techniques described herein.

In another implementation, the bonus award referred to in step 504 of FIG. 17 includes a personal progressive jackpot. In this implementation, preferably the top award in a weighted pay table, for instance, as described in FIGS. 14-16, would not exceed the player's contribution, because the progressive jackpot is an individual pool. In this implementation, as long as the expected value of the weighted pay table does not exceed what the player contributed, the casino remains profitable.

In step 504 of FIG. 17, one way in which the indication of the bonus award can arise is by the player redeeming a bonus which the player has qualified for during some previous activity. For instance, in one implementation, a player playing a game play session receives an indication that he has qualified for a bonus. The gaming machine at which the player is located issues a ticket indicating a later time or date at which the player can redeem the bonus, as is the case in a ReturnPlay scheme. In one embodiment, the actual award amount to be provided is not determined until a later time at which the player returns to redeem the bonus award. Thus, in one example, when the player returns to the casino at a designated time and inserts the ticket in a ticket reader of a suitable gaming device or kiosk, the device or kiosk generates and sends a message to the host device, indicating that a particular bonus award amount is now to be determined, in step 504. In this embodiment, there are two separate sessions. In the first session, the player is playing a game during a gaming session, hits a threshold, and wins an award. However, the randomness of determining the award amount is delayed until a later session, referred to herein as the redemption session, that is, a later time or date at which the player returns to the casino to redeem the award. In one embodiment, to fuel the mystery and intrigue of the bonus, the ticket the player receives does not provide any indication as to the value of the award, and only upon redemption, is a presentation of the bonus award generated and displayed on a suitable display screen of the device at which the ticket is redeemed, indicating the actual award amount determined in method 500.

In FIG. 17, in step 508, responsive to receiving the indication of the bonus award in step 504, the selection parameter 216, described above with reference to FIG. 14, is retrieved by the host server. The selection parameter can be retrieved from a suitable storage medium, in some embodiments, while in other embodiments, the selection parameter is delivered to the host device as part of a message or signal from another device in the network, such as the gaming machine at which the player is located. Various parameters can be used as the selection parameter in step 508.

In FIG. 17, in step 512, the host device 504 accesses the storage medium at which the weighted pay tables, such as tables 204-212 described above, are stored. As described above, these weighted pay tables are configured to have associated parameter values for comparison with the selection parameter 216. Thus, using selection parameter 216, in step 516, when one of the weighted pay tables has a parameter matching the selection parameter 216, that weighted pay table is selected as the table from which the ultimate bonus award amount is to be determined.

In FIG. 17, in step 520, the host device or other processing engine on the network randomly determines one of the award amounts listed in the selected weighted pay table according to the defined probabilities associated with all of the award amounts in the table. The particular award listed in the selected weighted pay table, determined in step 520, is delivered as the bonus award for the player, in step 524.

In FIG. 17, in step 524, the determined bonus award can be delivered to the player in various ways and at various locations. In one implementation, the bonus award is applied to the credit meter at the gaming device where the player is located. In another implementation, the award amount or an indication of the award is encoded or printed on a redeemable ticket, output from a ticket mechanism of a bonus award device, such as the gaming machine, a kiosk, or some other data processing apparatus. The bonus award output in step 524 can be output from a remote location, such as a cashier's desk, requiring the player to visit the cashier to obtain the reward, thus providing additional security. In addition to the bonus award being delivered to the gaming machine over the network, the bonus award can be delivered to other various devices, including data processing apparatus operated in conjunction with a table game. Thus, in one implementation, a message can be displayed at the player's gaming machine, instructing the player to visit a designated table in the casino to collect the bonus award. A dealer or other suitable casino employee located at the table game can receive the bonus award and deliver it to the player. In another implementation, the player can redeem the award automatically at the table game, by inserting his or her player tracking card in a card or ticket reader associated with the data processing apparatus at the table game. The various devices at which the bonus award can be provided for collection by the player can be in proximity to the gaming machine or at remote locations with respect to the gaming device at which the bonus award is announced, as described above.

In one implementation, a group of players can qualify for the same bonus award to be collected local to the gaming machines at which the players are located or at a remote location. Such can be the case when an unidentifiable group of players, such as a tour group, are all participating in gaming sessions at machines in the casino. In another example, a group of players all playing the same bank of machines can qualify for an award, such as a consolation prize. The bonus award determination steps 508-524 of method 500 can then be performed.

In FIG. 17, in steps 504 and 524, the announcement as well as the delivery of bonus awards can be provided over different gaming machine modules and interfaces. For instance, the bonus award can be provided through a player tracking network, a server-based service window communication scheme, as well as the ticketing mechanisms described herein. Thus, the determination and delivery of bonus awards in accordance with the methods and apparatus described herein can apply to individual gaming machines as well as a server-based environment, including banks of gaming machines, for instance, participating in tournaments, as well as table games. Any one or more of these devices can participate in the server-based determination and delivery of bonus awards by having an appropriate interface to the gaming network for communication with the host device, as described herein with reference to FIG. 1.

Although the foregoing embodiments of the present invention have been described in detail by way of illustration and example for purposes of clarity and understanding, it will be recognized that the above described inventive aspects may be embodied in numerous other specific variations and embodiments without departing from the spirit or essential characteristics of the present invention. Certain changes and modifications may be practiced, and it is understood that the present invention is not to be limited by the foregoing details, but rather is to be defined by the scope of the appended claims.

What is claimed is:

1. A gaming system for awarding a bonus to a player of one or more wager-based games of chance, the gaming system comprising:

a gaming device configured to play one or more games of chance responsive to an indication of a wager; and a host device in communication with the gaming device over a network, the host device including a processor configured to:

i) receive an indication of a bonus award to be provided to a player of the gaming device, ii) select one of a plurality of weighted pay tables stored in a storage medium, each weighted pay table including a plurality of award values and a plurality of probabilities, each award value having an associated one of the probabilities, the award values of a first one of the weighted pay tables being in a first range, the award values of a second one of the weighted pay tables being in a second range, the first range being different from the second range, iii) randomly determine one of the plurality of award values in the selected weighted pay table in accordance with the plurality of probabilities, the randomly determined award value being a bonus award, and iv) provide a bonus award notification including information related to the bonus award.

2. The gaming system of claim 1, the bonus award notification including an indication of a range of a value of the bonus award based on the selected weighted pay table.

3. The gaming system of claim 1, the bonus award notification including an indication of a maximum value of the bonus award based on the selected weighted pay table.

4. The gaming system of claim 1, the bonus award notification including an indication of a time and a location for redemption of the bonus award.

5. The gaming system of claim 1 , each weighted pay table having an expected value (EV), wherein the EV is determined by a gaming establishment.

6. The gaming system of claim 5, each weighted pay table having a different EV.

7. The gaming system of claim 5, each weighted pay table having the same EV.

8. The gaming system of claim 1, wherein the processor is further configured to: retrieve a selection parameter; and select one of a plurality of weighted pay tables stored in the storage medium using the selection parameter.

9. The gaming system of claim 8, wherein the selection parameter indicates one of a plurality of player levels associated with the player; and wherein selecting one of the plurality of weighted pay tables using the selection parameter includes:

selecting a weighted pay table corresponding to the indicated player level.

10. The gaming system of claim 8, the selection parameter indicating one of a plurality of player ranks associated with the player.

11. The gaming system of claim 1, randomly determining one of the plurality of award values occurring responsive to the player qualifying for the bonus award.

12. The gaming system of claim 1, the system further comprising:

a display configured to display a presentation of the bonus award notification.

13. The gaming system of claim 1, wherein one or more of the plurality of awards values in the weighted pay table are defined by a multiplier applied to a base award amount.

14. The gaming system of claim 1, wherein the plurality of award values are non-cash awards.

15. A bonus award device configured to award a bonus to a player of one or more wager-based games of chance, the bonus award device comprising:

an I/O mechanism configured to receive a portable medium and read information on the portable medium indicating a bonus award to be provided;

a controller configured to:

i) respond to reading the information indicating the bonus award to be provided, ii) select one of a plurality of weighted pay tables stored in a storage medium, each weighted pay table including a plurality of award values and a plurality of probabilities, each award value having an associated one of the probabilities, the award values of a first one of the weighted pay tables being in a first range, the award values of a second one of the weighted pay tables being in a second range, the first range being different from the second range, iii) randomly determine one of the plurality of award values in the selected weighted pay table in accordance with the plurality of probabilities, the randomly determined award value being a bonus award, and iv) provide a bonus award notification including information related to the bonus award; and a display configured to display a presentation of the bonus award notification.

16. The bonus award device of claim 15, further comprising:

a value input mechanism configured to receive an indication of a wager for play of one or more games of chance; and a value output mechanism configured to output a winning for play of the one or more games of chance.

17. The bonus award device of claim 15, the presentation of the bonus award notification including an indication of a range of a value of the bonus award.

18. The bonus award device of claim 15, the presentation of the bonus award notification including an indication of a maximum value of the bonus award.

19. The bonus award device of claim 15, the presentation of the bonus award notification including an indication of a time and a location for redemption of the bonus award.

20. A method for awarding a bonus to a player of a gaming device configured to play one or more games of chance responsive to an indication of a wager, the method comprising:

receiving an indication of a bonus award to be provided to a player of the gaming device;

selecting one of a plurality of weighted pay tables stored in a storage medium, each weighted pay table including a plurality of award values and a plurality of probabilities, each award value having an associated one of the probabilities, the award values of a first one of the weighted pay tables being in a first range, the award values of a second one of the weighted pay tables being in a second range, the first range being different from the second range;

randomly determining one of the plurality of award values in the selected weighted pay table in accordance with the plurality of probabilities, the randomly determined award value being a bonus award; and providing a bonus award notification including information related to the bonus award.

* * * * *